US006522964B1

(12) United States Patent
Miki et al.

(10) Patent No.: US 6,522,964 B1
(45) Date of Patent: Feb. 18, 2003

(54) CONTROL APPARATUS AND CONTROL METHOD FOR A CONSTRUCTION MACHINE

(75) Inventors: Masatoshi Miki, Tokyo (JP); Mitsuru Hikiyama, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 09/355,223

(22) PCT Filed: Oct. 13, 1998

(86) PCT No.: PCT/JP98/04623

§ 371 (c)(1),
(2), (4) Date: Aug. 30, 1999

(87) PCT Pub. No.: WO99/27195

PCT Pub. Date: Jun. 3, 1999

(30) Foreign Application Priority Data

Nov. 25, 1997 (JP) ..... 9-323444

(51) Int. Cl.[7] ..... G06F 19/00; E02F 9/26
(52) U.S. Cl. ..... 701/50; 701/33; 172/315
(58) Field of Search ..... 701/50, 35, 33, 701/36; 172/4.5, 9, 161, 303, 304, 315

(56) References Cited

U.S. PATENT DOCUMENTS 5,174,115 A 12/1992 Jacobson et al. ..... 60/484
5,557,510 A * 9/1996 McIntyre et al. ..... 701/50
5,854,988 A * 12/1998 Davidson et al. ..... 701/50
5,897,600 A * 4/1999 Elmore et al. ..... 701/50
5,957,213 A * 9/1999 Loraas et al. ..... 172/2
6,061,617 A * 5/2000 Berger et al. ..... 701/50

FOREIGN PATENT DOCUMENTS

| | | |
|---|---|---|
| EP | 0 741209 A2 | 11/1996 |
| JP | 5-287782 | 2/1993 |
| JP | 6-57948 | 12/1994 |
| JP | 7-259141 | 9/1995 |

* cited by examiner

*Primary Examiner*—Tan Nguyen
(74) *Attorney, Agent, or Firm*—Morrison & Foerster LLP

(57) ABSTRACT

A control apparatus and a control method for a construction machine make it possible to set an operation condition suitable for the working attachment by a simple operation with certainty, even if unique information of a working attachment cannot be inputted. To this end, a control apparatus for a construction machine to which a working attachment is attached is constructed that includes a control section for controlling a hydraulic power source based on unique information about the working attachment, a display section which performs discrimination failure display when the type of the working attachment has not successfully been discriminated, and a standard set valve setting section for setting, when the discrimination failure display is performed by the display section, the type of the working attachment and a standard value regarding the operation condition of the working attachment, and that the control section is capable of controlling the hydraulic power source based on the operation condition set based on the unique information of the working attachment of information of the standard set valve set by the standard set valve setting section.

19 Claims, 18 Drawing Sheets

FIG. 4

| ADDRESS | CODE | CONTENTS |
|---|---|---|
| A001 | CA | ハ |
| A002 | DD | ン |
| A003 | CF | マ |
| A004 | B0 | ー |
| A005 | 41 | A |
| A006 | 42 | B |
| A007 | 43 | C |
| A008 | 39 | 9 |
| A009 | 39 | 9 |
| A00A | 30 | 0 |
| A00B | 44 | D |

CONTROLLER SIDE FLOW CHART

CONTROL APPARATUS AND CONTROL METHOD FOR A CONSTRUCTION MACHINE

TECHNICAL FIELD

This invention relates to a control apparatus and a control method for a construction machine such as a hydraulic excavator to which a plurality of working attachments such as, for example, a bucket and a breaker (hammer) can be attached, and more particularly to a control apparatus and a control method for a construction machine suitable for use with a construction machine wherein a type and so forth of an attachment attached to a construction machine body can be displayed.

BACKGROUND ART

Conventionally, in a construction machine such as a hydraulic excavator which is a kind of working machine, various working attachments such as a breaker (hydraulic hammer) and a bucket can be removably attached comparatively readily so that the construction machine can perform various works.

Here, a construction machine such as a hydraulic excavator to which a breaker 2 is attached as a working attachment is described with reference to FIG. 18.

As shown in FIG. 18, in a construction machine 1 such as a hydraulic excavator, an upper revolving unit (construction machine body) 101 is mounted for revolving motion in a horizontal plane on a lower travelling body 100. The upper revolving unit 101 includes a main frame 102, and an operator cab 103, an engine room 104 and so forth provided on the main frame 102.

A boom 105 is connected for pivotal motion to the upper revolving unit 101 by a pin not shown, and a stick 106 is connected for pivotal motion to an end portion of the boom 105 by a pin 105A.

A working attachment (hereinafter referred to simply as attachment) 2 such as a breaker (hydraulic hammer) is connected for pivotal motion to an end portion of the stick 106 by a pin 106A. The attachment 2 is removably attached to the end portion of the stick 106. It is to be noted that, in FIG. 18, a breaker is shown attached as the attachment 2.

A boom driving hydraulic cylinder (boom driving actuator) 107 for expanding or contracting the distance between end portions thereof to drive the boom 105 to pivot with respect to the upper revolving unit 101 is interposed between the upper revolving unit 101 and the boom 105.

A stick driving hydraulic cylinder (stick driving actuator) 108 for expanding or contracting the distance between end portions thereof to drive the stick 106 to pivot with respect to the boom 105 is interposed between the boom 105 and the stick 106.

An attachment driving hydraulic cylinder 109 for expanding or contracting the distance between end portions thereof to drive the attachment 2 to pivot with respect to the stick 106 is interposed between the stick 106 and the attachment 2. The attachment driving hydraulic cylinder 109 is mounted for pivotal motion on the stick 106 and the attachment 2 with rods 110 and 111 interposed therebetween.

The attachment 2 is a kind of hydraulic actuator and individually has a unique operation condition (rated supply oil pressure and flow rate). For example, even if the attachment 2 is of the same type, if the maker and the capacity are different, then also the rated supply oil pressure and/or flow rate required are different, and also an optimum operation condition is different.

Therefore, working oil to be supplied from hydraulic pumps 5 and 6 must be controlled so as to satisfy an operation condition unique to each attachment.

Thus, a technique is available wherein registers corresponding to varieties of the rated pressure and flowrate of the attachment (here, breaker) 2 are provided in a control apparatus for a construction machine and a battery is connected to the registers, and one of electric signals (here, electric currents) of them is inputted to an solenoid proportional valve through a manually operable changeover switch so that it is converted by the solenoid proportional valve into an oil pressure, which is inputted to a pump regulator.

With such a control apparatus for a construction machine as just described, however, when the attachment 2 is to be operated, the manually operable changeover switch must be changed over every time to the register with which a necessary supply oil pressure and flow rate are obtained in advance. This operation is cumbersome and incidentally deteriorates the working efficiency.

Therefore, another technique has been proposed wherein, when the attachment 2 is to be attached to the construction machine body 101, unique information of the attachment 2 to be attached (information regarding the type of the attachment 2 and an operation condition of the attachment 2) is inputted to the control apparatus for the construction machine and the type of the attachment 2 is automatically discriminated based on the unique information, and a unique operation condition (pump discharge pressure, flow rate and so forth) required for each attachment 2 can be automatically set in accordance with the type.

However, in case a failure in contact or the like occurs with the control system, the type of the attachment 2 may be discriminated but in error or a wrong operation condition may be set for the attachment 2. In such an instance, since an operation condition required by the attachment 2 attached to the construction machine body 101 is not set, an original function of the attachment 2 attached cannot be exhibited.

Further, if the control system suffers from some disconnection or a like trouble, unique information of the attachment 2 attached may not be inputted to the control apparatus. Also in this instance, discrimination of the type of the attachment 2 or setting of an operation condition of the attachment 2 cannot be performed automatically by the control apparatus, and an original function of the attachment 2 attached cannot be exhibited.

Therefore, it is a possible idea to provide a display apparatus in the operator cab 103 of the construction machine body 101 such that the type of the attachment 2 is displayed on the display apparatus so that the operator can confirm a result of the automatic discrimination and, when unique information of the attachment 2 is not inputted, discrimination failure display is performed on the display apparatus.

However, only if discrimination failure display is performed on the display apparatus, discrimination of the type of the attachment 2 or setting of an operation condition of the attachment 2 cannot be performed, and no essential solution can be obtained.

The present invention has been made in view of such a subject as described above, and it is an object of the present invention to provide a control apparatus and a control method for a construction machine by which, even if unique information of a working attachment attached to a construction machine body cannot be inputted, an operation condition suitable for the working attachment attached can be set with certainty by a simple operation.

DISCLOSURE OF INVENTION

According to the present invention, there is provided a control apparatus for a construction machine wherein a working attachment is removably attached to a construction machine body, characterized in that it comprises a control section for discriminating a type of the working attachment and controlling a hydraulic power source, which supplies working oil to the working attachment, based on unique information for setting an operation condition required by the working attachment in accordance with the type, a display section for displaying the type of the working attachment discriminated by the control section and performing discrimination failure display when the control section has failed to discriminate the type of the working attachment, and a standard set value setting section for setting, when the discrimination failure display is performed by the display section, the type of the working attachment and a standard value regarding the operation condition of the working attachment, and that the control section is capable of controlling the hydraulic power source based on the operation condition set based on the unique information of the working attachment or information of the standard set value set by the standard set value setting section.

Due to such a construction as described above, there is an advantage that, although discrimination failure display is performed by the display section if unique information of an attachment attached to the construction machine body cannot be inputted to the control section and the control section fails to discriminate the type of the attachment, also in this instance, a standard set value regarding an operation condition suitable for the attached working attachment can be set by a simple operation and with certainty by the standard set value setting section. Consequently, a hydraulic power source can be controlled based on information of the standard set value, and the working attachment can be operated in an appropriate operation condition.

Preferably, the control apparatus for a construction machine further comprises a confirmation switch for performing an operation for a premise of start of control by the control section, and the control section starts control of the hydraulic power source after confirming a switch operation by the confirmation switch.

Due to such a construction as just described, it can be confirmed by an operation of the confirmation switch that a correct confirmation condition of the working attachment has been set, and control of the hydraulic power source is started after the switch operation by the confirmation switch is confirmed by the control section. Consequently, there is an advantage that, even if the control section discriminates the type of the working attachment in error because of some disconnection or the like, inappropriate hydraulic power source control is prevented from being performed.

Preferably, the standard set value setting section includes a plurality of set standard values to which a priority order is applied, and the control section is capable of controlling the hydraulic power source based on the operation condition set based on the unique information of the working attachment or information of a standard set value from the standard set value setting section selected in accordance with the priority order.

Due to such a construction as just described, since a standard set value is selected in accordance with the priority order, there is an advantage that setting of a standard set value by an operator can be performed smoothly.

Preferably, the display section performs discrimination failure display when the control section discriminates by a predetermined number of times that the unique information is not normal.

Preferably, when the standard set value is set by the standard set value setting section, the display section displays the type of the working attachment and the standard set value regarding the operation condition of the working attachment.

Preferably, control apparatus for a construction machine further comprises changing means for changing the standard set value.

Due to such a construction as just described above, there is an advantage that, since the standard set value can be changed by the standard set value changing means, an operation condition more suitable to the attached working attachment can be set.

Preferably, the changing means includes a changing switch which is capable of being manually operated by an operator.

Preferably, the changing switch is provided on the display section, and change of the type of the working attachment and the standard set value regarding the operation condition of the working attachment which is performed by an operation of the changing switch is capable of being performed while the type of the working attachment and the standard set value regarding the operation condition of the working attachment displayed on the display section are confirmed.

Preferably, the control apparatus for a construction machine further comprises a unique information storage member for discriminating the type of the working attachment and storing the unique information for setting the operation condition required by the working attachment in accordance with the type, and the control section automatically sets discrimination of the type of the working attachment and the operation condition required by the working attachment based on the unique information fetched from the unique information storage member.

Preferably, the unique information storage member is an IC memory, a connector, a bar code or a transmitter.

Where the unique information storage member is a transmitter, preferably the transmitter performs transmission of the unique information to the control section by wire communication or by radio communication.

Where the transmitter performs transmission of the unique information to the control section by wire communication or by radio communication, preferably the transmitter performs transmission of the unique information to the control section through a data communication interface or through a buffer.

According to the present invention, there is provided a control method for a construction machine wherein a working attachment is removably attached to a construction machine body for discriminating a type of the working attachment and controlling a hydraulic power source for supplying working oil to the working attachment based on unique information for setting an operation condition required by, the working attachment in accordance with the type, characterized in that it comprises a displaying step in which a type display mode wherein the discriminated type of the working attachment is displayed on a display section and a discrimination failure display mode wherein discrimination failure display is performed on the display section when the type of the working attachment cannot be discriminated are taken selectively, a standard set value setting step of setting, when the discrimination failure display is performed in the displaying step, the type of the working attachment and a standard set value regarding the operation condition of the working attachment, and a controlling step of controlling the hydraulic power source based on the operation condition set based on the unique information of the working attachment or information of the standard set value set in the standard set value setting step.

Due to such a construction as described above, there is an advantage that, although discrimination failure display is performed by the display section if unique information of an attachment attached to the construction machine body cannot be inputted to the control section and the control section fails to discriminate the type of the attachment, also in this instance, a standard set value regarding an operation condition suitable for the attached working attachment can be set by a simple operation and with certainty by the standard set value setting section. Consequently, a hydraulic power source can be controlled based on information of the standard set value, and the working attachment can be operated in an appropriate operation condition.

BRIEF DESCRIPTION OF THE DRAWINGS

FIG. 4 is a view illustrating code information of a type of an attachment in the control apparatus and the control method for a construction machine according to the first embodiment of the present invention;

BEST MODE FOR CARRYING OUT THE INVENTION

In the following, embodiments of the present invention are described with reference to the drawings.

(A) Description of the First Embodiment

First, a control apparatus and a control method for a construction machine according to a first embodiment of the present invention are described with reference to FIGS. 1A to 9.

Since the control apparatus for a construction machine according to the present embodiment is provided in a construction machine such as a hydraulic excavator, the construction machine such as a hydraulic excavator is described first.

Figure 18:
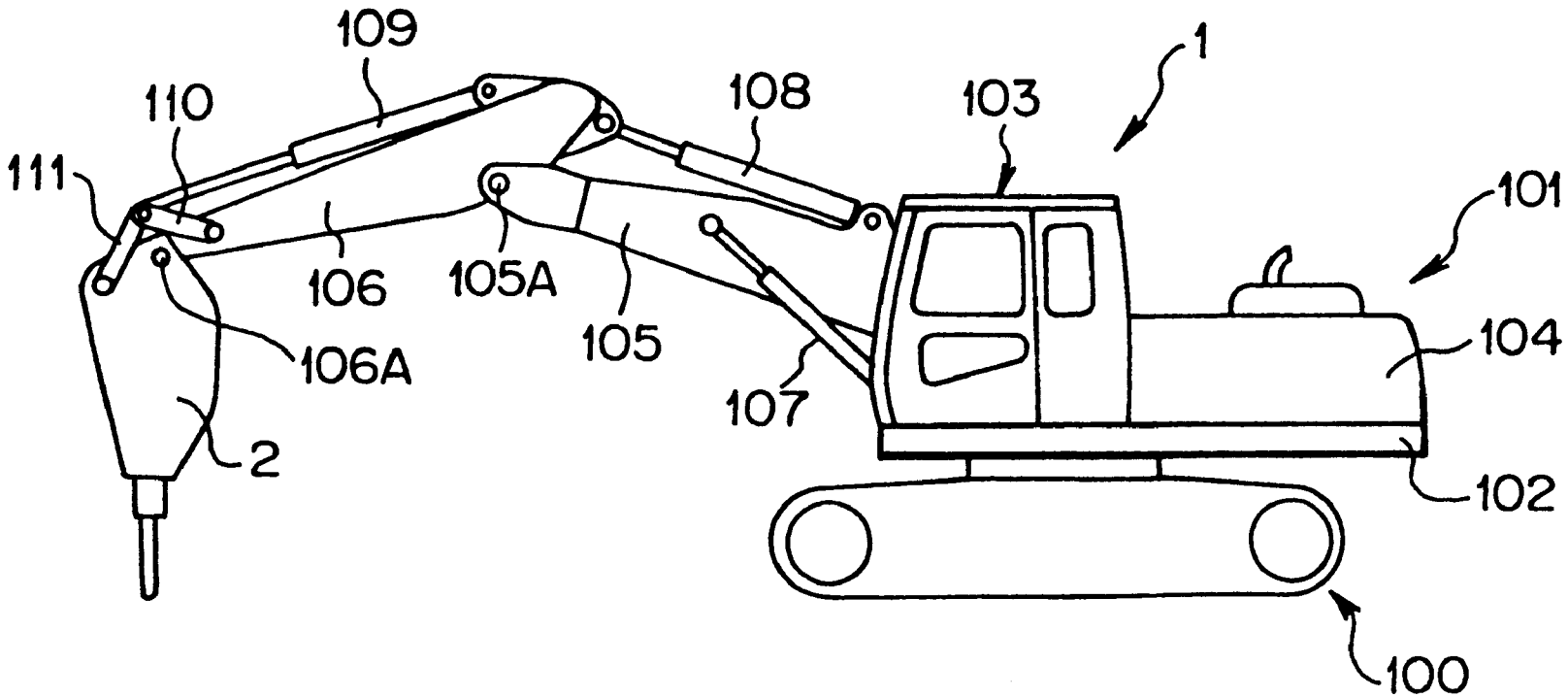
FIG. 18 is a schematic view showing a conventional construction machine.

In the construction machine 1 such as al hydraulic excavator, as described hereinabove in connection with the prior art (refer to FIG. 18), an upper revolving unit (construction machine body) 101 is mounted for revolving motion in a horizontal plane on a lower travelling body 100. The upper revolving unit 101 includes a main frame 102, and an operator cab 103, an engine room 104 and so forth provided on the main frame 102.

A boom 105 is connected for pivotal motion to the upper revolving unit 101 by a pin not shown, and a stick 106 is connected for pivotal motion to an end portion of the boom 105 by a pin 105A.

An attachment (working attachment) 2 such as a breaker (hydraulic hammer) is connected for pivotal motion to an end portion of the stick 106 by a pin 106A. The attachment 2 is removably attached to the end portion of the stick 106. It is to be noted that, in FIG. 18, a breaker is shown attached as the attachment 2.

A boom driving hydraulic cylinder (boom driving actuator) 107 for expanding or contracting the distance between end portions thereof to drive the boom 105 to pivot with respect to the upper revolving unit 101 is interposed between the upper revolving unit 101 and the boom 105.

A stick driving hydraulic cylinder (stick driving actuator) 108 for expanding or contracting the distance between end portions thereof to drive the stick 106 to pivot with respect to the boom 105 is interposed between the boom 105 and the stick 106.

An attachment driving hydraulic cylinder 109 for expanding or contracting the distance between end portions thereof to drive the attachment 2 to pivot with, respect to the stick 106 is interposed between the stick 106 and the attachment 2. The attachment driving hydraulic cylinder 109 is mounted for pivotal motion on the stick 106 and the attachment 2 with rods 110 and 111 interposed therebetween.

Figure 1A:
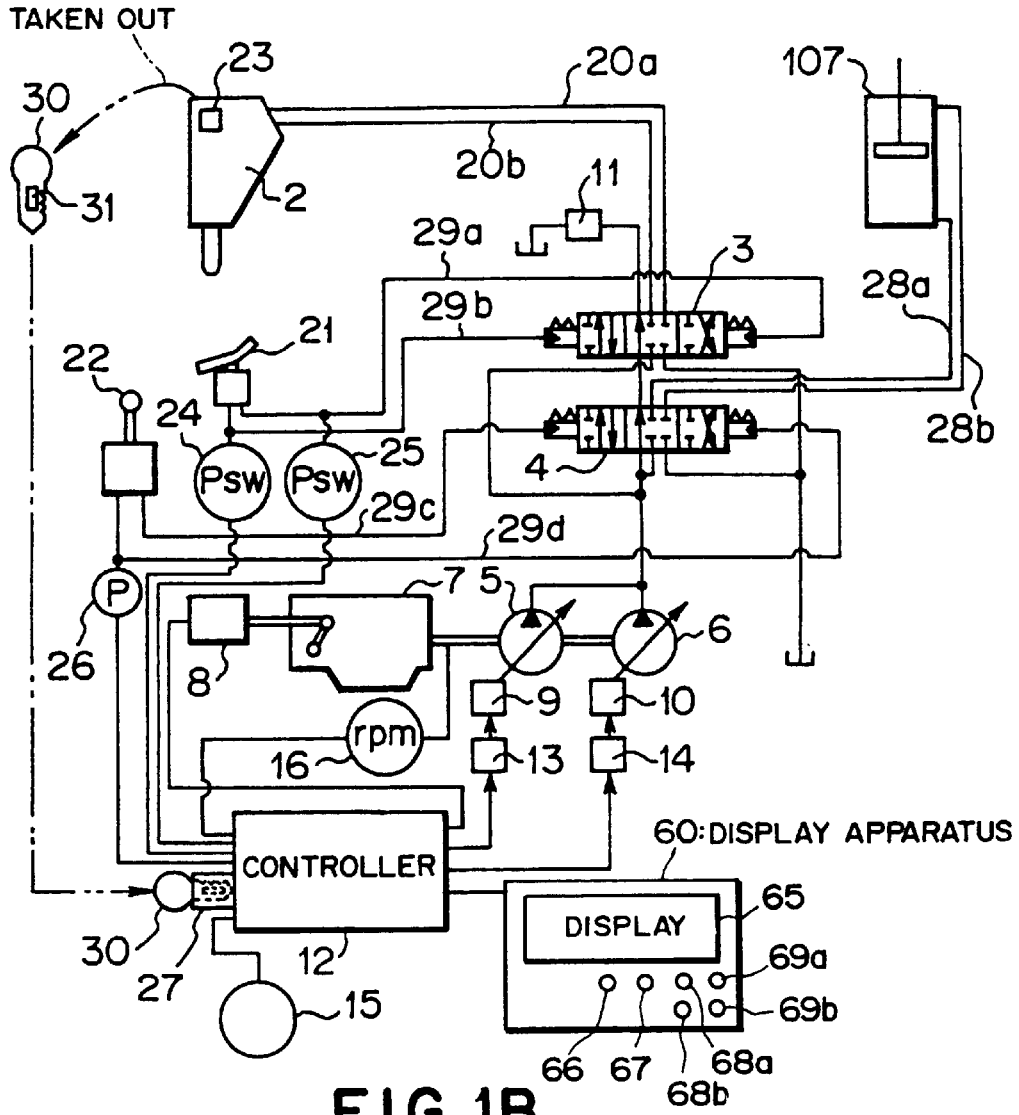
FIG. 1A is a schematic view showing an entire construction of a control apparatus and a control method for a construction machine according to a first embodiment of the present invention.

In order to supply working oil for driving such hydraulic cylinders 107, 108 and 109 and attachment 2 as described above, hydraulic pumps 5 and 6 are provided on the upper revolving unit 101 as shown in FIG. 1A. It is to be noted that, of the hydraulic cylinders 107, 108 and 109, only the boom driving hydraulic cylinder 107 is shown in FIG. 1A.

Working oil from the hydraulic pumps 5 and 6 is supplied to the attachment 2 through oil paths 20*a* and 20*b*. A control valve 3 is interposed in the oil paths 20*a* and 20*b* so that it can control supply and discharge of working oil to and from the attachment 2.

The control valve 3 is pilot operated, for example, by a pedal type operator 21 through pilot oil paths 29*a* and 29*b*.

Working oil from the hydraulic pumps 5 and 6 is supplied to the boom driving hydraulic cylinder 107 through oil paths 28*a* and 28*b*. A control valve 4 is interposed in the oil paths 28*a* and 28*b* so that it can control supply and discharge of working oil to and from the boom driving hydraulic cylinder 107.

The control valve 4 is pilot operated, for example, by a pedal type operator 22 through pilot oil paths 29*c* and 29*d*.

In such a construction machine as described above, the engine speed of a pump driving Diesel engine 7 which are adjusted by moving the accelerator position by an accelerator actuator 8 and pump regulators 9 and 10 are controlled by a controller 12 serving as a control section to adjust the discharge flow rate of the hydraulic pumps 5 and 6.

To this end, various sensors and so forth are provided for the present construction machine, and signals from the sensors and so forth are inputted to the controller 12 serving as a control section.

In particular, an accelerator dial 15 for setting an engine speed of the pump driving Diesel engine 7 is provided so that the operator can manually set the engine speed. A signal from the accelerator dial 15 is inputted to the controller 12.

Also an engine speed sensor 16 is provided for the pump driving Diesel engine 7 so that an actual engine speed of the pump driving Diesel engine 7 can be detected. A signal from the engine speed sensor 16 is inputted to the controller 12.

The controller 12 compares a target speed set by the accelerator dial 15 and an actual engine speed detected by the accelerator dial 15 with each other and calculates a control amount for driving the accelerator actuator 8 so that they may coincide with each other. A signal corresponding to the control amount is outputted to the accelerator actuator 8. Consequently, the engine speed is controlled so as to be equal to the target speed and the discharge flow rate of the hydraulic pumps 5 and 6 is controlled.

In order to control the pump output power so that working can be performed efficiently in accordance with an engine speed and a working load, the controller 12 outputs signals for controlling the output powers of the hydraulic pumps 5 and 6 to solenoid proportional valves 13 and 14 based on the engine speed and the accelerator dial position. The signals from the controller 12 are converted into oil pressures by the solenoid proportional valves 13 and 14, and the oil pressures obtained by the conversion are outputted to the pump regulators 9 and 10 so that the discharge flow rates of the hydraulic pumps 5 and 6 are controlled.

For example, if the accelerator dial position is the maximum and the engine speed is higher than a rated value, then signals for raising the pump output powers are outputted from the controller 12 to the solenoid proportional valves 13 and 14, and oil pressures obtained by conversion of them by the solenoid proportional valves 13 and 14 are sent to the pump regulators 9 and 10 so that the flow rates from the hydraulic pumps 5 and 6 are controlled so as to be increased. On the contrary, if the engine speed is lower than the rated value, then signals for lowering the pump output powers conversely are outputted from the controller 12 to the solenoid proportional valves 13 and 14, and oil pressures obtained by conversion of them by the solenoid proportional valves 13 and 14 are sent to the pump regulators 9 and 10 so that the flow rates from the hydraulic pumps 5 and 6 are controlled so as to be decreased so that the engine output power may not be exceeded.

A flow control valve 11 is installed on the downstream side of the control valve 3 along a center bypass line, and a pressure signal on the upstream side of the control valve 3 is connected to the pump regulators 9 and 10 such that so-called negative feedback flow rate control may be performed by the pump regulators 9 and 10 so that, when the pressure is high, the pump flow rate may decrease, but when the pressure is low, the pump flow rate may increase. It is to be noted that those connections are omitted in FIG. 1A.

Pressure switches ($P_{SW}$) 24 and 25 are provided for the pilot oil paths 29*a* and 29*b* so that an operation condition of the control valve 3 can be detected from presence or absence of an operation. Signals from the pressure switches 24 and 25 are inputted to the controller 12.

When the signals from the pressure switches 24 and 25 are signals of presence of an operation, the controller 12 outputs signals corresponding to an operation condition required by the attachment 2 to the solenoid proportional valves 13 and 14 through a pump driver 44 and also to the accelerator actuator 8 through an engine driver 45.

A pressure sensor (P) 26 is provided for the pilot oil paths 29*c* and 29*d* so that it can proportionally detect an operation state of the control valve 4. A signal from the pressure sensor 26 is inputted to the controller 12.

When, for example, the attachment 2 is operated simultaneously with another actuator (here, the boom driving hydraulic cylinder) and the boom driving hydraulic cylinder 107 is caused to perform a contracting operation (to move down the boom 105), the controller 12 outputs signals to the solenoid proportional valves 13 and 14 through the pump driver 44 and to the accelerator actuator 8 through the engine driver 45 so that the pump discharge flow rate may be increased so as to obtain a driving speed of the boom driving hydraulic cylinder 107 corresponding to a signal of the pressure sensor 26.

By the way, in the control apparatus for a construction machine according to the present embodiment, the controller 12 automatically discriminates the type of an attachment 2 attached to the construction machine body 101 and automatically sets a unique operation condition (a supply oil pressure, flow rate and so forth) necessary for the attached attachment 2 to operate appropriately to control the hydraulic pumps 5 and 6.

To this end, a key-type IC memory holder 30 for holding an IC memory 31 is removably attached to the attachment 2 of the construction machine body 1 as shown in FIG. 1A. In particular, the attachment 2 includes a box 23, and the key-type IC memory holder 30 is provided in the box 23.

The key-type IC memory holder 30 has a surface on which a contact portion (refer to reference symbol contact portion 36*a* of FIG. 2) from which contents of the IC memory 31 can be fetched is formed.

The IC memory (unique information storage member) 31 held by the key-type IC memory holder 30 stores unique information to be used to discriminate the type of the attachment 2 and set an operation condition required by the attachment 2.

Meanwhile, the controller 12 of the present construction machine body 1 has a key cylinder type connection section 27 provided thereon for fetching, when the key-type IC memory holder 30 taken out from the box 23 is inserted into the connection section 27, unique information of the attachment 2 stored in the IC memory 31 held by the key-type IC memory holder 30.

In particular, when the key-type IC memory holder 30 taken out from the box 23 of the attachment 2 is inserted into the key cylinder type connection section 27 as if a key were inserted into a keyhole, the contact portion 36*a* of the key-type IC memory holder 30 and a contact portion 36*b* in the connection portion 27 on the controller 12 side are brought into contact with each other, and unique information of the attachment 2 is fetched from the IC memory 31 held by the key-type IC memory holder 30 to the controller 12 side through the contact portions 36*a* and 36*b*.

Now, a hardware construction of the IC memory 31 and the controller 12 is described with reference to FIG. 2.

Figure 2:
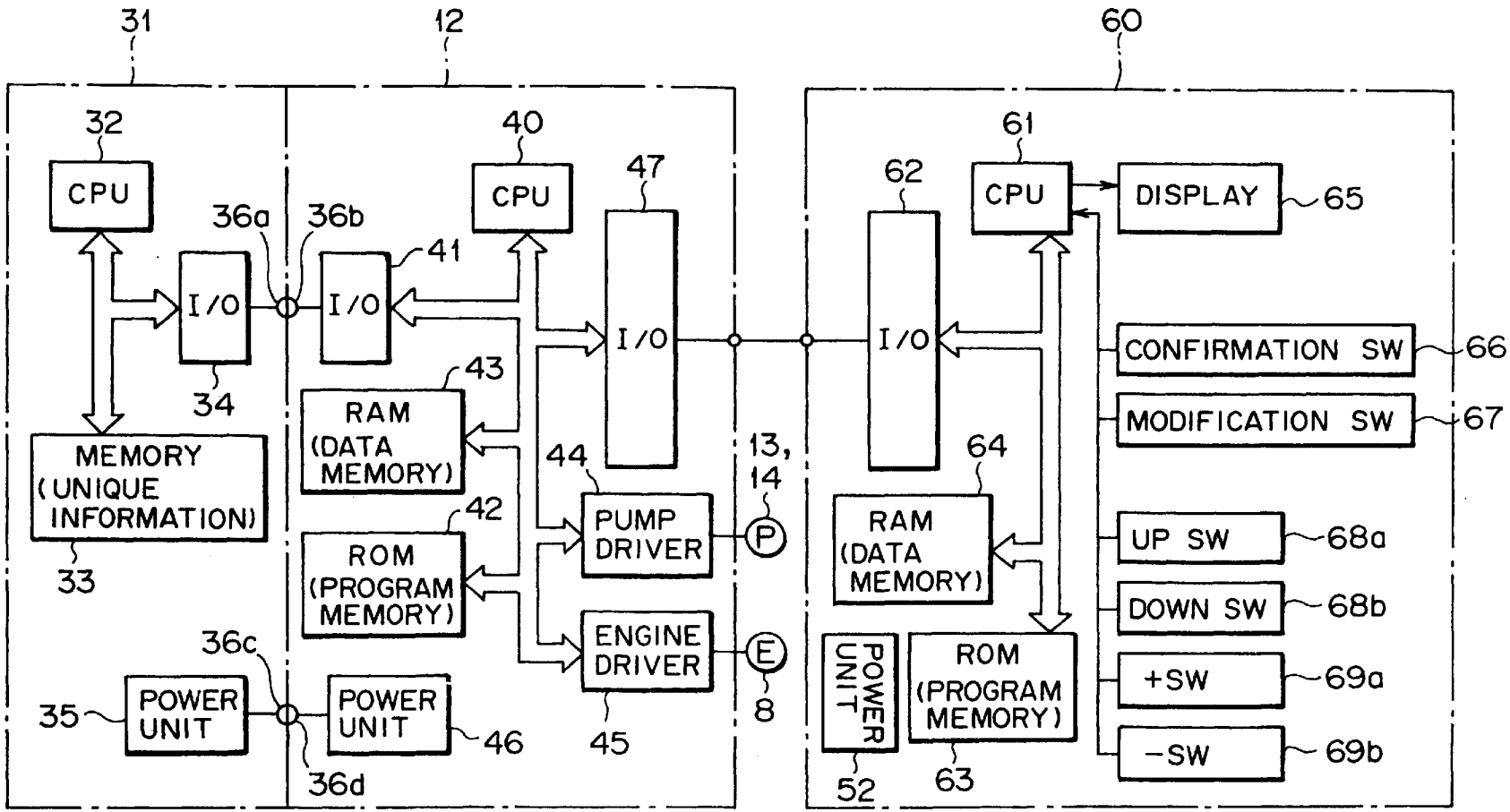
FIG. 2 is a control block diagram of the control apparatus and the control method for a construction machine according to the first embodiment of the present invention.

First, the hardware construction of the IC memory 31 includes, as shown in FIG. 2, a memory 33 serving as a data storage device for storing unique information of an attachment 2 (a non-volatile memory such as a flash memory is used as the memory 33), a central processing unit (hereinafter referred to as CPU) 32 which performs fetching processing of unique information from the memory 33 and so forth, an input/output device (I/O, interface; hereinafter referred to as I/O) 34 serving as transmission means for receiving a fetching instruction signal from the controller 12 of the construction machine body 101 side to the CPU 32 and transmitting unique information taken out from the memory 33 by the CPU 32 to the controller 12 of the upper revolving unit 101 side, a power supply unit (hereinafter, referred to as power unit) 35 for receiving supply of power from a power unit 46 of the controller 12 of the upper revolving unit 101 side.

If the key-type IC memory holder 30 is mounted onto the connection section 27 of the construction machine body 101 side which will be hereinafter described, then the input/output device 34 of the IC memory 31 held by the key-type IC memory holder 30 is connected to an inputting and outputting apparatus 41 of the controller 12 of the construction machine body 101 side through the contact portion 36*a* of the key-type IC memory holder 30 and the contact portion 36*b* of the controller 12 side.

Further, if the key-type IC memory holder 30 is mounted onto the connection section 27 of the construction machine body 101 side which will be hereinafter described, then the power unit 35 of the IC memory 31 provided in the key-type IC memory holder 30 is connected to the power unit 46 of the controller 12 of the construction machine body 101 side through a contact portion 36*c* of the key-type IC memory holder 30 and a contact portion 36*d* of the controller 12 side.

Here, the unique information stored in the memory 33 is information regarding identification, information regarding the type of the attachment 2, and information regarding an operation condition of the attachment 2 such as a rated flow rate, pressure and so forth, and more particularly is data regarding identification, data indicative of the type of the attachment 2, and hydraulic power source drive data such as the position (accelerator position) of the accelerator actuator 8 for controlling the engine speed of the engine 7 which drives the hydraulic pumps 5 and 6, a pump set power controlled by the pump regulators 9 and 10 and an increase coefficient. It is to be noted that the increase coefficient is an accelerator position correction coefficient A or a pump power correction coefficient B illustrated in FIG. 9.

As an example of information regarding an operation condition of the attachment 2, for example, the accelerator position of the engine 7 is set like engine speed=1,600 rpm, and the pump set power is set like pump torque=60%.

In order to control the hydraulic pumps 5 and 6 using the unique information of the attachment 2 fetched by the key cylinder type connection section 27, the controller 12 has such a hardware construction as described below.

In particular, the hardware construction of the controller 12 includes a CPU 40, an I/O 41 serving as transmission means for performing transmission to and reception from the IC memory 31, a read only memory (hereinafter referred to as ROM) 42 in which a processing program is stored, a random access memory (hereinafter referred to as RAM) 43 for storing unique information of an attachment 2 transmitted thereto from the IC memory 31, a pump driver 44 for driving the pump regulators 9 and 10 of the hydraulic power source through the solenoid proportional valves 13 and 14 to control the pump set power, an engine driver 45 for driving the accelerator actuator 8 of the hydraulic power source to control the speed of the engine 7, and a power unit 46 for operating the controller 12.

It is to be noted that also a program for automatically discriminating the type of an attachment 2 attached to the construction machine body 101 is stored in the ROM 42.

The CPU 40 performs communication of data with the ROM 42, RAM 43 and so forth over a bus line, discriminates the type of the attachment 2 based on unique information of the attachment 2 and sets an operation condition (a supply oil pressure and flow rate) required by the attachment 2 attached.

Figure 1B:
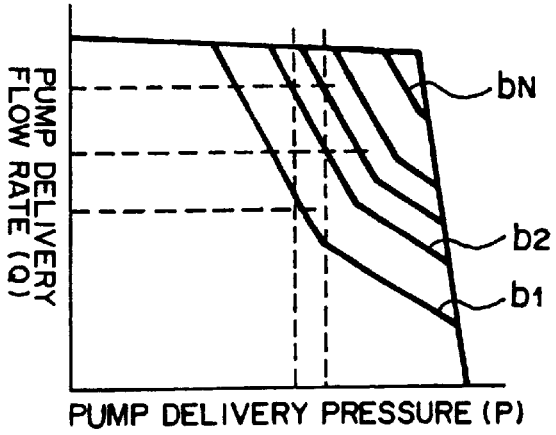
FIG. 1B is a pump power characteristic diagram illustrating a relationship between a delivery pressure (discharge pressure) and a delivery flow rate (discharge flow rate) of a hydraulic pump relating to the control apparatus and the control method for a construction machine according to the first embodiment of the present invention.

FIG. 1B illustrates a pump power characteristic diagram representing a relationship between the delivery pressure (discharge pressure) and the delivery flow rate (discharge flow rate) of the hydraulic pumps 5 and 6. Curve data of such various fixed pump powers PS1=b1, b2, . . . , bN as shown in FIG. 1B are stored in the ROM 42 of the controller 12.

The CPU 40 reads out a curve specified by unique information of the attachment being currently used from among such a plurality of fixed power curves as shown in FIG. 1B and selects set values for the pressure, flow rate and so forth for the individual attachment 2 based on the curve to set an operation condition required by the attachment 2.

The operation condition of the attachment 2 set in this manner is outputted, when signals from the pressure switches 24 and 25 are signals representing presence of an operation, to the solenoid proportional valves 13 and 14 through the pump driver 44 and also to the accelerator actuator 8 through the engine driver 45.

The controller 12 further has a function of adding, if it is detected by the pressure sensor 26 that the lever type operator 22 has been operated to the boom lowering side, a correction control condition calculated in accordance with an operation state of the control valve 4 which controls supply and discharge of working oil to and from the boom driving hydraulic cylinder 107 to the operation condition required by the attachment 2 which has been set in such a manner as described above.

By the way, a display apparatus (display section) 60 which includes a display unit 65 such as, for example, a liquid crystal display unit is connected to the controller 12 as shown in FIG. 1A so that it can be confirmed whether or not unique information of the attachment 2 has been fetched from the IC memory 31 to the controller 12 side.

The display apparatus 60 has a type display mode and a discrimination failure display mode and selectively takes one of the modes.

The type display mode is a mode in which, if unique information of the attachment 2 is inputted from the IC memory 31 to the controller 12 and the type of the attachment 2 can be discriminated by the controller 12, then the type of the attachment 2 discriminated is displayed on the display unit 65.

The discrimination failure display mode is a mode in which, when unique information of the attachment 2 cannot be inputted from the IC memory 31 to the controller 12 and the controller 12 cannot discriminate the type of the attachment 2, discrimination failure displayed is performed on the display unit 65.

A confirmation switch (confirmation SW) 66 is provided for the display apparatus 60, and if the operator confirms whether or not the type of the attachment 2 and/or a default value (standard set value) regarding an operation condition of the attachment 2 displayed on the display unit 65 are correct and operates the confirmation switch. 66 to an on-state, then a confirmation switch signal is outputted from the display apparatus 60 to the controller 12. Then, after the confirmation signal is inputted, the controller 12 starts control of the hydraulic pumps 5 and 6.

It is to be noted that, while reference symbols 67, 68*a*, 68*b*, 69*a* and 69*b* in FIG. 1A denote changing switches necessary for the operator to set the type of the attachment 2 and set a default value (standard set value) regarding an operation condition of the attachment 2 when the discrimination failure display is performed on the display unit 65 of the display apparatus 60, they are hereinafter described.

Now, a hardware construction of the display apparatus 60 is described with reference to FIG. 2.

The hardware construction of the display apparatus 60 includes, as shown in FIG. 2, a CPU 61, an I/O 62 serving as transmission means for performing transmission and reception to and from the controller 12, a ROM 63 serving as a program memory in which a processing program is stored, and a RAM 64 serving as a data memory for storing data regarding the type of an attachment 2 and an operation condition required by the attachment 2 which have been transmitted from the controller 12. Further, the display apparatus 60 can perform bidirectional serial communication with the controller 12. It is to be noted that also a power unit 52 for operating the display apparatus 60 is provided for the display apparatus 60.

The CPU 61 performs communication of data with the ROM 63 and the RAM 64 over a bus line so that a type of an attachment 2 and/or an operation condition required by the attachment 2 which are transmitted from the controller 12 are received through the inputting and outputting apparatus 62 and displayed on the display unit 65.

By the way, in the present embodiment, if discrimination failure display is performed on the display unit 65 of the display apparatus 60, then the operator can set a default value (standard set value) regarding an operation condition of an attachment 2 set in advance in the controller 12.

To this end, the controller 12 is constructed so as to have a function (default value setting section, standard set value setting section) of setting a default value regarding an operation condition of an attachment 2 described below.

First, if unique information of an attachment 2 (identification information, type information regarding the attachment 2 and/or information regarding an operation condition required by the attachment 2) is inputted from the IC memory 31, then the controller 12 checks the unique information to discriminate whether or not it is normal.

It is to be noted that, since it is likely to occur that the controller 12 suffers from a failure in contact or the like and cannot perform the checking accurately, the checking is performed repetitively by a predetermined number of times (N times), and if it is discriminated by the predetermined number of times (N times) that the unique information of the attachment 2 is not normal, then the controller 12 determines that the unique information of the attachment 2 is not normal.

If it is determined as a result of the checking that the unique information is not normal, then the controller 12 outputs a signal for discrimination failure display to the display apparatus 60. Consequently, the display apparatus 60 enters the discrimination failure display mode, in which discrimination failure display is performed by the display unit 65.

Then, after the controller 12 waits for a predetermined time (T seconds) in this state, it outputs a signal for default set display to the display apparatus 60. Consequently, default set display is performed on the display unit 65 of the display apparatus 60.

If discrimination failure display is performed on the display unit 65 of the display apparatus 60 in such a manner as described above, that is, when it is determined that the unique information of the attachment 2 is not normal, the CPU 40 of the controller 12 discriminates whether or not a priority order is set. If the controller 12 discriminates that a priority order is set, then it successively reads in data selected in accordance with the priority order from among the data representative of types of the attachment 2 stored in the ROM 42 and outputs the data to the display apparatus 60. However, if the controller 12 discriminates that no priority order is set, then it reads in data stored at a predetermined address (for example, the first address) from among the data representative of the types of the attachment 2 stored in the ROM 42 and outputs the data to the display apparatus 60.

Consequently, the data as code information is converted into characters representative of the type of the attachment 2 by the display apparatus 60 and displayed on the display unit 65.

In this instance, the priority order may be set such that, for example, each time an attachment 2 is attached, the thus attached attachment 2 is stored, and an attachment 2 which has been attached by a greater number of times has a high priority degree. It is to be noted that the method of setting a priority order is not limited to this.

Figure 3:
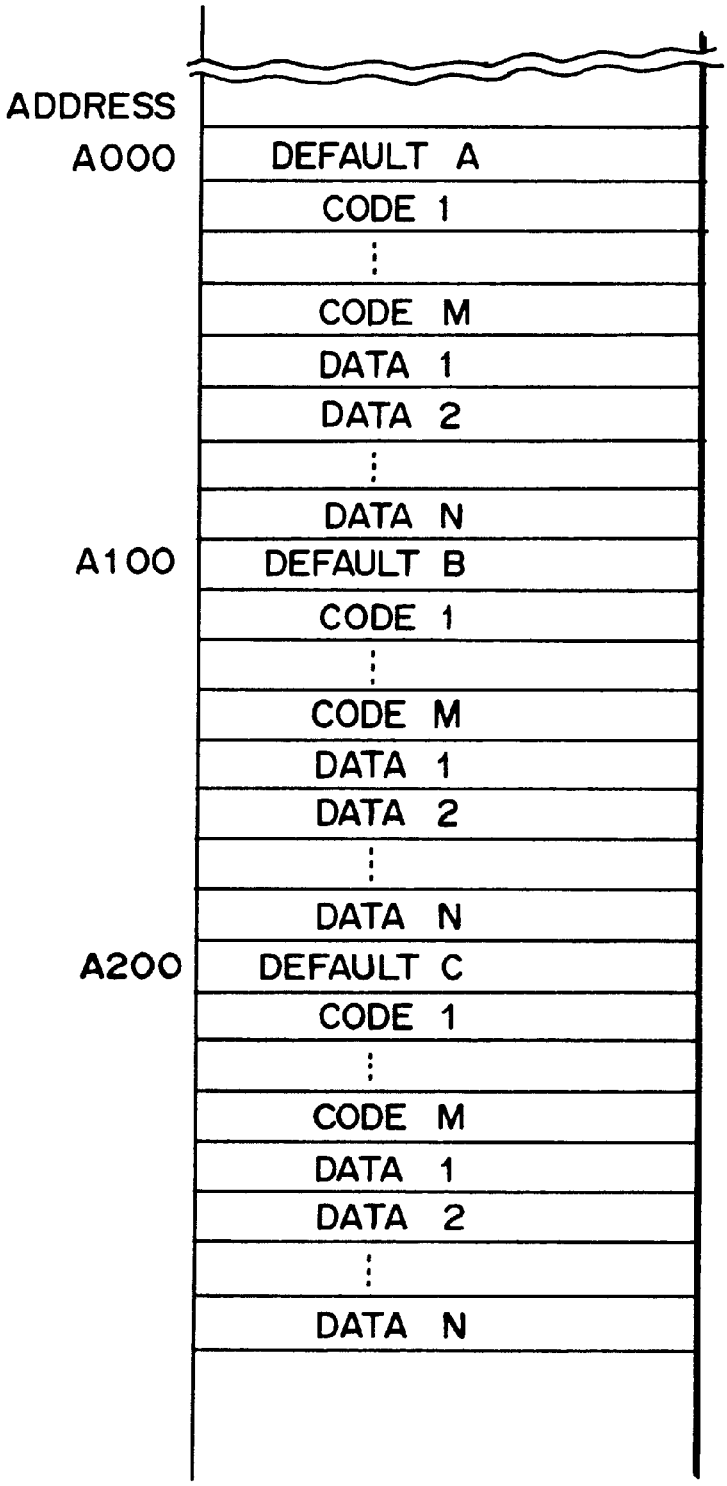
FIG. 3 is a view illustrating a data structure in the control apparatus and the control method for a construction machine according to the first embodiment of the present invention.

FIG. 3 is a view illustrating a data structure of data regarding identification, data regarding the!type of the attachment 2 and a plurality of default values regarding an operation condition of the attachment 2 stored in the ROM 42.

It is to be noted that, in FIG. 3, the default A, default B, default C and so forth denote data regarding identification; the code 1, code 2, . . . , code M denote data regarding the type of the attachment 2; and the data 1, data 2, . . . , data N denote data regarding default values of an operation condition of the attachment 2. It is to be noted that the data representative of the type of the attachment 2 is referred to as code, and data regarding an operation condition of the attachment 2 are referred to as data.

In the ROM 42, data regarding identification such as the default A, default B, default C and so forth are stored for individual addresses such as, for example, A000, A100, A200 and so forth as shown in FIG. 3.

Further, the code regarding the type of the attachment 2 denoted by the code 1, code 2, . . . , code M is, for example, "ﾊﾝﾏｰ ABC990D" and is stored as code information (such code information as hexadecimal code CA=ﾊ since the ASCII code is used here) at designated addresses (for example, A000, A001, . . . , A00B) as shown in FIG. 4.

It is to be noted that the code indicating the type of the attachment 2 may be "HAMMER990D" for English-speaking regions. Further, the code information is not limited to the ASCII code.

Further, a plurality of default values (here, N default values data 1, data 2, . . . , data N) regarding an operation condition of the attachment 2 for each type of the attachment 2 are stored as numerically represented code information as shown in FIG. 3. It is to be noted that the numerically represented code information is converted and displayed by the display apparatus 60.

If the confirmation switch 66 is operated to an on-state by the operator in the condition wherein the type of the attachment 2 is displayed on the display unit 65 in this manner, then the CPU 40 stores data of a default value stored at the predetermined address from among the data of the plurality of default values of the operation condition regarding the attachment 2 displayed on the display unit 65 into the RAM 43 to set the default values regarding the operation condition of the attachment 2.

On the other hand, if it is determined as a result of the checking of the unique information by the CPU 40 of the controller 12 that the unique information is normal, then addresses (a data start address and a data end address) of the codes regarding the type of the attachment 2 stored in the RAM 43 of the controller 12 are set based on the unique information, and the code representative of the type of the attachment 2 is read in from the RAM 43 based on the addresses and outputted to the display apparatus 60.

In this instance, the display apparatus 60 enters the type display mode, in which the code representative of the type of the attachment 2 discriminated is converted into characters and displayed, for example, like "ﾊﾝﾏｰ ABC990D" on the display unit 65.

If the confirmation switch 66 is operated to an on-state by the operator in the condition wherein the type of the attachment 2 is displayed on the display unit 65 i,n this manner, then the CPU 40 sets an operation condition of the attachment 2 based on the unique information of the attachment 2 having been read into the CPU 40 of the controller 12.

Then, the controller 12 controls the hydraulic pumps 5 and 6 based on the default values regarding the operation condition of the attachment 2 set by the default value setting section described hereinabove or the operation condition of the attachment 2 set based on the unique information of the attachment 2.

By the way, the present apparatus further has a function (standard set value changing means) of changing a default value regarding an operation condition of an attachment 2 set automatically in such a manner as described above.

To this end, the display apparatus 60 includes, as shown in FIGS. 1A and 2, an UP switch (UP SW) 68*a* and a DOWN switch (DOWN SW) 68*b* as changing switches so that an automatically set default value regarding an operation condition of the attachment 2 can be changed by operating the switch 68*a* or 68*b*.

In particular, if the operator operates the UP switch 68*a* or the DOWN switch 68*b* in a condition wherein the type of the attachment 2 is displayed on the display unit 65 of the display apparatus 60, then the CPU 40 of the controller 12 reads in a code representative of a type of another attachment 2 and outputs it to the display apparatus 60. In this instance, another type of the attachment 2 thus changed is displayed by the display apparatus 60.

For example, if the UP switch 68*a* is operated once, then a code representative of a type of the attachment 2 stored at an address preceding by one is read in, but if the DOWN switch 68*b* is operated once, then a code representative of a type of the attachment 2 stored in an address following by one is read in.

Here, each of the UP switch 68*a* and the DOWN switch 68*b* functions as a switch for changing the type of the attachment 2 displayed on the display unit 66.

If the confirmation switch 66 is operated into an on-state by the operator in a condition wherein the selected type of the attachment 2 is displayed on the display unit 65 in this manner, then the CPU 40 of the controller 12 stores the read-in code regarding the type of the attachment 2 into the RAM 43 to set the type of the attachment 2.

In this instance, the CPU 40 stores also data of default values stored at predetermined addresses from among the data of the plurality of default values regarding the operation condition of the attachment 2 into the RAM 43 to set the default values regarding the operation condition of the attachment 2.

Then, the controller 12 controls the engine 7 and the hydraulic pumps 5 and 6 based on the default values regarding the operation conditions of the attachment 2 set in such a manner as described above.

The display apparatus 60 further includes, as shown in FIGS. 1A and 2, a modification switch 67, a +switch (+SW) 69*a* and a −switch (−SW) 69*b* as changing switches in addition to the UP switch 68*a* and the DOWN switch 68*b* so that, by operating the switch 67, 69*a* or 69*b*, automatically set data of a default value regarding an operation condition of an attachment 2 can be changed in accordance with the type of the attachment 2 selected in such a manner as described above.

The modification switch 67 is provided to perform modification instruction of a default value regarding an operation condition of an attachment 2. It is to be noted that a holding type switch is used for the modification switch 67, and if it is switch operated, then it is put into an ON-state and this state is held, but if it is operated once again, then the ON-state is cancelled.

The UP switch 68*a* and the DOWN switch 68*b* are used to select a default value regarding an operation condition of an attachment 2 displayed on the display unit 65.

The +switch (+SW) 69*a* and the −switch (−SW) 69*b* are used to modify a default value regarding an operation condition of an attachment 2 displayed on the display unit 65.

In particular, if the operator operates the modification switch 67 in a condition wherein a type of an attachment 2 is displayed on the display unit 65, then the CPU 40 of the controller 12 reads in data stored at predetermined addresses from among the data of the plurality of default values regarding an operation condition of the attachment 2 stored in the ROM 42 and outputs the data to the display apparatus 60.

In this instance, the default values regarding the operation condition of the attachment 2 stored at the predetermined addresses are displayed on the display unit 65 of the display apparatus 60.

It is to be noted that, also in this instance, data are read in in accordance with a priority order similarly as in the case of reading in of a code regarding the type of the attachment 2 described hereinabove.

If the operator operates UP switch 68*a*, DOWN switch 68*b*, +switch 69*a* or −switch 69*b* in this state, then the CPU 40 of the controller 12 reads in data of default values stored at different addresses from among the data of the plurality of default values regarding the operation condition of the attachment 2 stored in the ROM 42.

For example, if the UP switch 68*a* is operated once, then the CPU 40 of the controller 12 reads in data stored at the address preceding by one (address=address −1), but if the DOWN switch 68*b* is operated once, then the CPU 40 of the controller 12 reads in data stored at the address following by one (address=address +1).

If the confirmation switch 66 is operated to an on-state by the operator in a condition wherein the selected default values regarding a selected operation condition of the attachment 2 is displayed, then the CPU 40 stores data of the selected default values regarding the operation condition of the attachment 2 to set the default value regarding the operation condition of the attachment 2.

Further, if the operator operates the +switch 69*a* or the −switch 69*b* in a condition wherein the selected default values regarding the operation condition of the attachment 2 are read in by the CPU 40 of the controller 12 and displayed on the display unit 65 of the display apparatus 60, then the CPU 40 of the controller 12 modifies the data of a read-in default value regarding the operation condition of the attachment 2 and outputs data regarding the modified default value of the attachment 2 to the display apparatus 60.

In this instance, the display apparatus 60 displays the data regarding the modified default values of the attachment 2 on the display unit 65.

For example, if the operator operates the +switch 69*a* once, then a predetermined value a set in advance is added to the data of the default value read in at present to modify the data of the default value of regarding the operation condition of the attachment 2, and this is outputted to the display apparatus 60.

On the other hand, if the operator operates the −switch 69*b* once, then the predetermined $\alpha$ set in advance is subtracted from the data of the default value read in currently to modify the data of the default value regarding the operation condition of the attachment 2 read in and outputs the modified data to the display apparatus 60.

If the confirmation switch 66 is operated to an on-state in a condition wherein the data regarding the default value of the attachment 2 modified in this manner is displayed on the display unit 65, then the CPU 40 stores the modified data of the default value regarding the operation condition of the attachment 2 into the RAM 43 to set the default value regarding the operation condition of the attachment 2.

It is to be noted that, in the present embodiment, for the convenience of data transmission to the display apparatus 60, a data start code and a data end code are outputted from the controller 12 to the display apparatus 60 so that the start and the end of the data may be discriminated.

Since the controller 12 as a default value setting section according to the present embodiment is constructed in such a manner as described above, processing is performed in the following manner.

First, processing in a main routine for setting an operation condition of an attachment 2 by the controller 12 serving as a default value setting section is described with reference to FIG. 5.

Processing of the main routine for setting of a default value by the controller 12 is started when an attachment 2 is attached to the construction machine body 101 and the supply to the controller 12 is made available.

Figure 5:
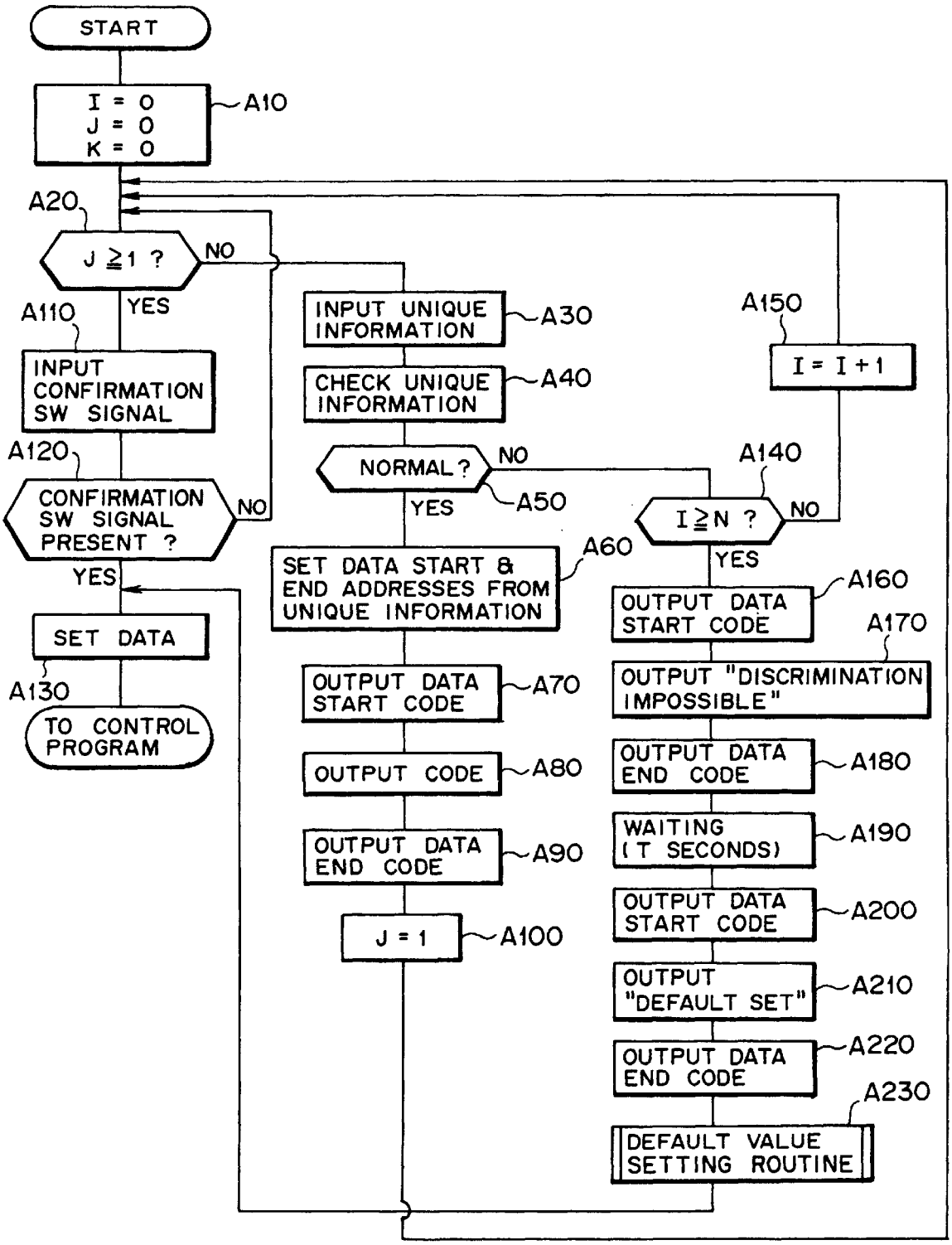
FIG. 5 is a flow chart illustrating processing of a main routine for setting an operation condition of an attachment 2 by a controller in the control apparatus and the control method for a construction machine according to the first embodiment of the present invention.

As shown in FIG. 5, first in step A10, a discrimination failure time number discrimination value I, a unique information normality flag J and an initial input discrimination value K are set to 0, whereafter, the control advances to step A20, in which it is discriminated whether or not the unique information normality flag J is at least 1 ($J \geqq 1$).

In this step A20, since the unique information normality flag J is 0 first, it is discriminated that the unique information normality flag J is not at least 1, and the control advances to step A30, in which unique information of the attachment 2 is inputted.

Then in step A40, the unique information of the attachment 2 inputted in step A30 is checked, and in step A50, it is discriminated whether or not the unique information of the attachment 2 is normal.

If a result of the discrimination indicates that the unique information of the attachment 2 is normal, then processing in steps A60 to A100 is performed in order to display the type of the attachment 2 as this unique information on the display unit 65 of the display apparatus 60.

In particular, in step A60, addresses (data start and end addresses) of the code regarding the type of the attachment 2 stored in the RAM 43 of the controller 12 are set, and the code regarding the type of the attachment 2 is read into the CPU 40.

Then in step A70, the data start code is outputted to the display apparatus 60, and in step A80, the code regarding the type of the attachment 2 is outputted to the display apparatus 60. Further, in step A90, the data, end code is outputted to the display apparatus 60. It is to be noted that processing of the display apparatus 60 side is hereinafter described.

Then in step A100, the unique information normality flag J is set to 1, whereafter the control returns to step A20, in which it is discriminated again whether or not the unique information normality flag J is at least 1. In this instance, since the unique information normality flag J is set to 1, it is discriminated that the unique information normality flag J is at least 1, and the control advances to step A110, in which, if the operator confirms the contents of the display and operates the confirmation switch 66, then a signal from the confirmation switch 66 is inputted.

Then in step A120, it is discriminated whether or not a signal has been received from the confirmation switch 66, and if it is discriminated that a signal has been received from the confirmation switch 66, then the control advances to step A130.

Instep A130, data setting is performed. In particular, the read in code regarding the type of the attachment 2 is stored into the RAM 43 to set the type of the attachment 2, and also predetermined default values corresponding to the type of the attachment 2 are stored into the RAM 43 to automatically set also the default values regarding an operation condition of the attachment 2, whereafter the control advances to the main routine for processing a processing program for controlling the present construction machine.

On the other hand, if it is discriminated in step A120 that a signal has not been received from the confirmation switch 66, then the control returns to step A20 again, whereafter the processing in steps. A20, A110 and A120 is repeated until after a signal is received from the confirmation switch 66.

By the way, if it is discriminated in step A50 that the unique information inputted in step A30 is not normal, then the control advances to step A140, in which it is discriminated whether or not the discrimination failure time number discrimination value I is at least N.

If a result of this discrimination indicates that the discrimination failure time number discrimination value I is not at least N, then the control advances to step A150, in which the discrimination failure time number discrimination value I is incremented by one, that is, a value obtained by adding 1 to I is set as the discrimination failure time number discrimination value I newly, whereafter the control returns to step A20. Thereafter, the processing in steps A20 to A50 and A140 is repeated until the discrimination failure time number discrimination value I reaches N. Consequently, so-called retrying of unique information inputting is performed by N times.

On the other hand, if it is discriminated in step A140 that the discrimination failure time number discrimination value I is at least N, that is, if the unique information is not normal even if unique information inputting is retried by N times, then processing in steps A160 to A180 is performed in order to display "discrimination failure" on the display unit 65 of the display apparatus 60.

In particular, in step A160, the data start code is outputted to the display apparatus 60, and in step A170, a "discrimination failure" signal is outputted to the display apparatus 60. Further in step A180, the data end code is outputted to the display apparatus 60. It is to be noted that processing of the display apparatus 60 side is hereinafter described.

Then, after the controller 12 waits for a predetermined time (T seconds) (step A190), processing in steps A200 to A220 is performed in order to display "default set" on the display unit 65 of the display apparatus 60.

In particular, in step A200, the data start code is outputted to the display apparatus 60, and in step A210, a "default set" signal is outputted to the display apparatus 60. Further in step A220, the data end code is outputted to the display apparatus 60. It is to be noted that processing of the display apparatus 60 side is hereinafter described.

Then, in order for the default value setting section of the controller 12 to set default values, the control advances to step A230, in which processing in a default value setting routine which will be hereinafter described is performed, whereafter the control returns to step A130 in order to set data of the default values regarding an operation condition of the attachment 2 set by the default value setting section of the controller 12 as the operation condition of the attachment 2 (data setting).

In step A130, the code regarding the type of the attachment 2 and the data of the default values regarding the operation condition of the attachment which have been read into the CPU 40 by the default setting routine are stored into the RAM 43 to set the type of the attachment 2 and the default values regarding the operation condition of the attachment, whereafter the control advances to the main routine for processing the control program for controlling the present construction machine.

Now, processing of the default value setting routine for setting a type of an attachment 2 and default values regarding an operation condition of the attachment 2 is described with reference to FIG. 6.

Figure 6:
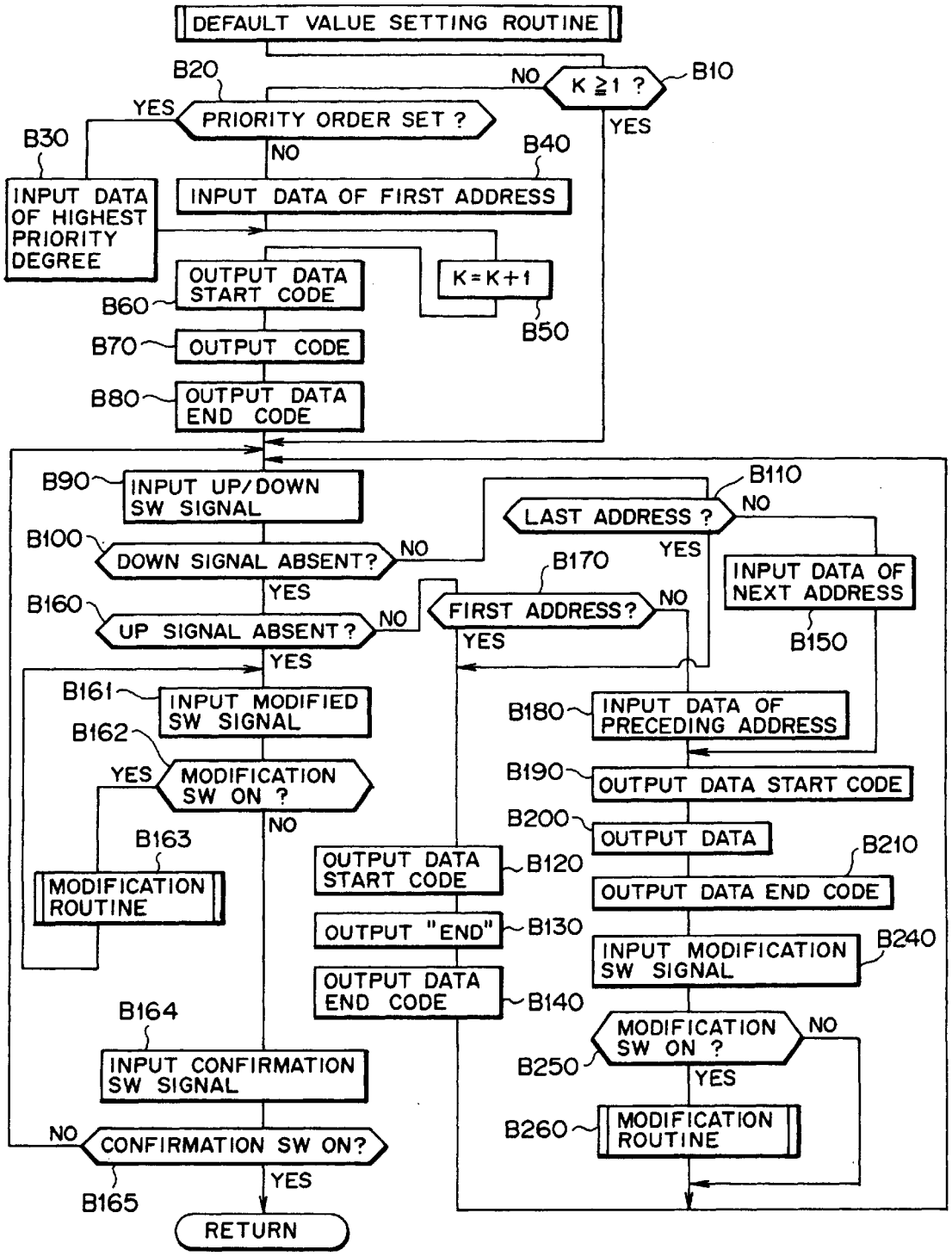
FIG. 6 is a flow chart illustrating processing of a default value setting routine by the controller in the control apparatus and the control method for a construction machine according to the first embodiment of the present invention.

As shown in FIG. 6, first in step B10, it is discriminated whether or not the initial input discrimination value K is at least 1. It is discriminated that the initial input discrimination value K is not at least 1 only when this routine is executed first, and consequently, processing of steps B20 to B80, that is, inputting of a code regarding the type of the attachment 2 for setting default values regarding an operation condition of the attachment 2, is performed only once.

In this step B10, since the initial input discrimination value K is set to 0 in the initial stage, it is discriminated that the initial input discrimination value K is not at least 1, and the control advances to step B20, in which it is discriminated whether or not a priority order is set.

If a result of this discrimination indicates that a priority order is set, then the control advances to step B30, in which a code regarding the type of the attachment 2 which has the highest priority degree is inputted to the CPU 40 of the controller 12.

On the other hand, if it is discriminated that a priority order is not set, then, the control advances to step B40, in which the code regarding the type of the attachment 2 stored in the first address is inputted to the CPU 40 of the controller 12.

Then in step B50, a value obtained by adding 1 to the initial input discrimination value K is set as the initial input discrimination value K, and processing in steps B60 to B80 is performed.

In particular, in step B60, the data start code is outputted to the display apparatus 60, and in step B70, the code regarding the type of the attachment 2 is outputted to the display apparatus 60. Further in step B80, the data end code is outputted to the display apparatus 60. It is to be noted that processing of the display apparatus 60 is hereinafter described.

Then in step B90, a signal from the UP switch 68*a* or of the DOWN switch 68*b* of the display apparatus 60 is inputted, and the control advances to step B100, in which it is discriminated whether or not a signal has been received from the DOWN switch 68*b*.

If a result of the discrimination indicates that a signal has been received from the DOWN switch 68*b*, then the control advances to step B110, in which it is discriminated whether or not the address of the code regarding the type of the attachment 2 is the last address.

If a result of the discrimination in step B110 indicates that the address of the code regarding the type of the attachment 2 is not the last address, then the control advances to step B150, in which data of the address following the code regarding the type of the attachment 2 inputted to the CPU 40 of the controller 12 at present is inputted to the CPU 40 of the controller 12, and processing in steps B190 to B210 is performed in order to display the code regarding the type of the attachment 2 stored in the following address on the display unit 65 of the display apparatus 60.

In particular, the data start code is outputted to the display apparatus 60 in step B190, and in step B200, the code regarding the type of the attachment 2 at the following address is outputted to the display apparatus 60, whereafter the data end code is outputted to the display apparatus 60 in step B210. It is to be noted that processing of the display apparatus 60 is hereinafter described.

Then, if it is discriminated in step B110 that the address in question is the last address, then processing in steps B120 to B140 is performed in order to display "END" on the display unit 65 of the display apparatus 60.

In particular, in step B120, the data start code is outputted to the display apparatus 60, and in step B130, an "END" signal is outputted to the display apparatus 60, whereafter the data end code is outputted to the display apparatus 60 in step B140. It is to be noted that processing of the display apparatus 60 is hereinafter described.

Then after "END" is displayed on the display unit 65 of the display apparatus 60, the control returns to step B90, in which inputting of a signal from the UP switch 68*a* or the DOWN switch 68*b* of the display apparatus 60 is performed.

By the way, if it is discriminated in step B100 that no signal has been received from the DOWN switch 68*b*, then the control advances to step B160, in which it is discriminated whether or not a signal has been received from the UP switch 68*a*.

If a result of the discrimination indicates that no signal has been received from the UP switch 68*a* either, then since there is no instruction for changing the type of the attachment 2, the control advances to step B161.

Then in step B161, a signal from the modification switch 67 is inputted to the controller 12, whereafter the control advances to step B162, in which it is discriminated whether or not the modification switch 67 is ON.

If a result of the discrimination indicates that the modification switch 67 is not ON, then the control advances to step B164, in which a signal from the confirmation switch 66 is inputted to the controller 12, whereafter the control advances to step B165.

It is discriminated in step B165 whether or not the confirmation switch 66 is ON, and if a result of the discrimination indicates that the confirmation switch 66 is not ON, then the control returns to step B90, and the processing is repeated. On the other hand, if it is discriminated that the confirmation switch 66 is ON, then the default value setting routine is ended, and the control advances to the main routine illustrated in FIG. 5.

On the other hand, if it is discriminated in step B162 that the modification switch 67 is ON, then the control advances to step B163, in which processing of a modification routine which will be hereinafter described is performed, whereafter the control returns to step B161, but if it is discriminated in step B162 and step B165 that no signal has been received from the modification switch 67 and a signal has been received from the confirmation switch 66, then the default value setting routine is ended, and the control advances to the main routine illustrated in FIG. 5.

By the way, if it is discriminated in step B160 that a signal has been received from the UP switch 68*a*, then the control advances to step B170.

In step B170, it is discriminated whether or not the address of the code regarding the type of the attachment 2 is the first address.

If a result of the discrimination in step B170 indicates that the address of the code regarding the type of the attachment 2 is not the first address, then the control advances to step B180, in which data of the address preceding to the code regarding the type of the attachment 2 inputted to the CPU 40 of the controller 12 at present is inputted to the CPU 40 of the controller 12, and processing of steps B190 to B210 is performed in order to display the code regarding the type of the attachment 2 stored in the preceding address on the display unit 65 of the display apparatus 60.

In particular, in step B190, the data start code is outputted to the display apparatus 60, and in step B200, the code regarding the type of the attachment 2 stored in the preceding address is outputted to the display apparatus 60, whereafter the data end code is outputted to the display apparatus 60 in step B210. It is to be noted that processing of the display apparatus 60 is hereinafter described.

Then, if it is discriminated in step B170 that the address in question is the first address, the processing in steps B120 to B140 is performed as described hereinabove in order to display "END" on the display unit 65 of the display apparatus 60.

In particular, the data start code is outputted to the display apparatus 60 in step B120, and in step B130, an "END" signal is outputted to the display apparatus 60, whereafter the data end code is outputted to the display apparatus 60 in step B140. It is to be noted that processing of the display apparatus 60 side is hereinafter described.

Then, after "END" is displayed on the display unit 65 of the display apparatus 60, the control returns to step B90, in which inputting of a signal from the UP switch 68*a* or the DOWN switch 68*b* is performed as described hereinabove.

Thereafter, in step B240, a signal from the modification switch 67 is inputted to the controller 12, and then, the control advances to step B250, in which it is discriminated whether or not the modification switch 67 is ON. If a result of the discrimination indicates that the modification switch 67 is not ON, then the control returns to step B90. If it is discriminated in steps B100 and B110 that no signal has been received from any of the UP switch 68*a* and the DOWN switch 68*b* and further it is discriminated in steps B162 and B165 that no signal has been received from the modification switch 67 but a signal has been received from the confirmation switch 66, then the default value setting routine is ended, and the control returns to the main routine illustrated in FIG. 5.

On the other hand, if it is discriminated that the modification switch 67 is ON, then processing of the modification routine which will be hereinafter described is performed, whereafter the control returns to step B90. If it is discriminated in steps B100 and B110 that no signal has been received from any of the UP switch 68*a* and the DOWN switch 68*b* and further it is discriminated in steps B162 and B165 that no signal has been received from the modification switch 67 but a signal has been received from the confirmation switch 66, then the default value setting routine is ended, and the control returns to the main routine illustrated in FIG. 5.

Figure 7:
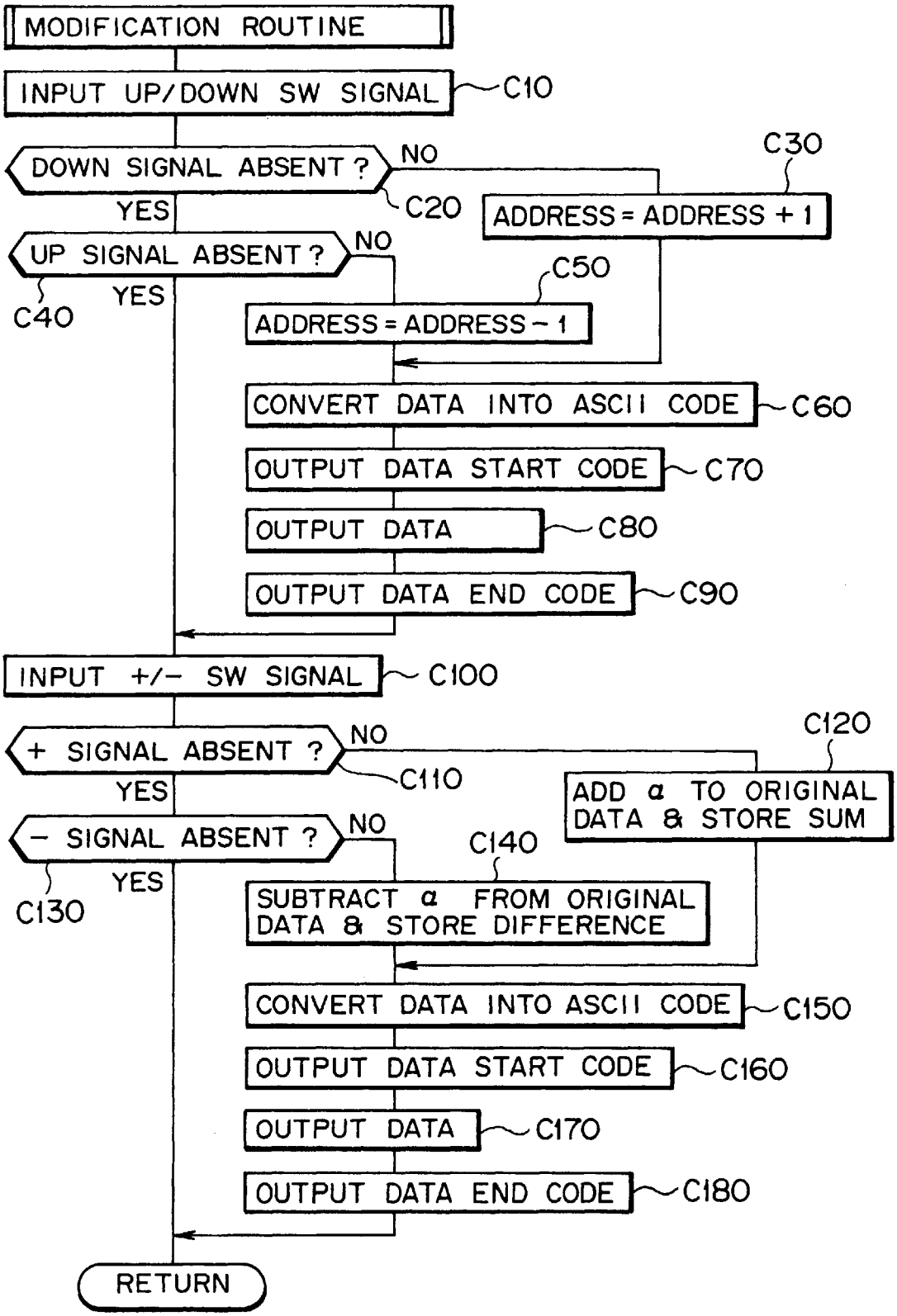
FIG. 7 is a flow chart illustrating processing of a modification routine by the controller in the control apparatus and the control method for a construction machine according to the first embodiment of the present invention.

Now, processing in the modification routine is described with reference to FIG. 7.

It is to be noted that, when processing in the modification routine is performed, a signal from the modification switch 67 has been inputted to the CPU 40 of the controller 12, and data of default values stored at predetermined addresses from among a plurality of default values regarding an operation condition of the attachment 2 stored in the ROM 42 have been read in by the CPU 40 and outputted to the display apparatus 60. Then, on the display unit 65 of the display apparatus 60, the default values regarding the operation condition of the attachment 2 stored at the predetermined address are displayed.

First, in step C10, a signal from the UP switch 68*a* or the DOWN switch 68*b* of the display apparatus 60 is inputted, and then the control advances to step C20, in which it is discriminated whether or not a signal has been received from the DOWN switch 68*b*.

If a result of the discrimination indicates that a signal has been received from the DOWN switch 68*b*, then the control advances to step C30, in which data at the address (address=address +1) following the data of the default values regarding the operation condition of the attachment 2 inputted to the CPU 40 of the controller 12 is inputted to the CPU 40 of the controller 12, and in order to display the data of default value regarding the operation condition of the attachment 2 stored in the following address on the display unit 65 of the display apparatus 60, the data is converted into an ASCII code in step C60, whereafter processing in steps C70 to C90 is performed.

In particular, in step C70, the data start code is outputted to the display apparatus 60, and in step C80, the data of the default value regarding the operation condition of the attachment 2 stored in the following address is outputted to the display apparatus 60, whereafter the data end code is outputted to the display apparatus 60 in step C90. It is to be noted that processing of the display apparatus 60 is hereinafter described.

On the other hand, if it is discriminated that no signal has been received from the DOWN switch 68*b*, then the control advances to step C40, in which it is discriminated whether or not a signal has been received from the UP switch 68*a*.

If a result of the discrimination indicates that a signal has been received from the UP switch 68*a*, then the control advances to step C50, in which data of the default value in the address (address=address −1) preceding to the data of the default value regarding the operation condition of the attachment 2 inputted to the CPU 40 of the controller 12 is inputted to the CPU 40 of the controller 12, and in order to display the data of the default value regarding the operation condition of the attachment 2 stored in the preceding address on the display unit 65 of the display apparatus 60, the data is converted into an ASCII code in step C60, whereafter processing in steps C70 to C90 is performed.

In particular, the data start code is outputted to the display apparatus 60 in step C70, and in step C80, the data of the default value regarding the operation condition of the attachment 2 stored in the preceding address is outputted to the display apparatus 60. Further in step C90, the data end code is outputted to the display apparatus 60. It is to be noted that processing of the display apparatus 60 is hereinafter described.

On the other hand if it is discriminated in step C40 that no signal has been received from the UP switch 68*a* either, the control advances to step C100, in which a signal from the +switch 69*a* or the −switch 69*b* of the display apparatus 60 is inputted to the CPU 40 of the controller 12, whereafter the control advances to step C110.

In step C110, it is discriminated whether or not a signal has been received from the +switch 69*a*, and if a result of the discrimination indicates that a signal has been received from the +switch 69*a*, then the control advances to step C120, in which the data of the default value is modified by adding the predetermined amount $\alpha$ to the data of the default value regarding the operation condition of the attachment 2 selected in such a manner as described above, and this is stored, whereafter the control advances to step C150.

Then, in order to display the modified default value on the display unit 65 of the display apparatus 60, the data of the default value as numerical information is converted into an ASCII code for character display in step C150, whereafter processing in steps C160 to C180 is performed.

In particular, in step C160, the data start code is outputted to the display apparatus 60, and in step C170, the data of the modified default value regarding the operation condition of the attachment 2 is outputted to the display apparatus 60, whereafter the data end code is outputted to the display apparatus 60 in step B80. It is to be noted that processing of the display apparatus 60 is hereinafter described.

On the other hand, if it is discriminated in step C110 that no signal has been received from the +switch 69*a*, then the control advances to step C130, in which it is discriminated whether or not a signal has been received from the −switch 69*b*.

If a result of the discrimination indicates that a signal has been received from the −switch 69*b*, then the control advances to step C140, in which the predetermined amount a is subtracted from the data of the default value regarding the operation condition of the attachment 2 selected in such a manner as described above to modify the data of the default value and this is stored, whereafter the control advances to step C150.

Then, in order to display the modified default value on the display unit 65 of the display apparatus 60, the data of the default value as numerical information is converted into an ASCII code for character display in step C150, whereafter processing of steps C160 to C180 is performed.

In particular, in step C160, the data start code is outputted to the display apparatus 60, and in step C170, the modified data of the default value regarding the operation condition of the attachment 2 is outputted to the display apparatus 60, whereafter the data end code is outputted to the display apparatus 60 in step B80. It is to be noted that processing of the display apparatus 60 is hereinafter described.

On the other hand, if it is discriminated in step C130 that no signal has been received from the −switch 69*b*, then the control returns to the default value setting routine illustrated in FIG. 6.

Now, processing of the display apparatus 60 in relation to the controller 12 as such a standard set value setting section as described above is described with reference to FIG. 8.

Figure 8:
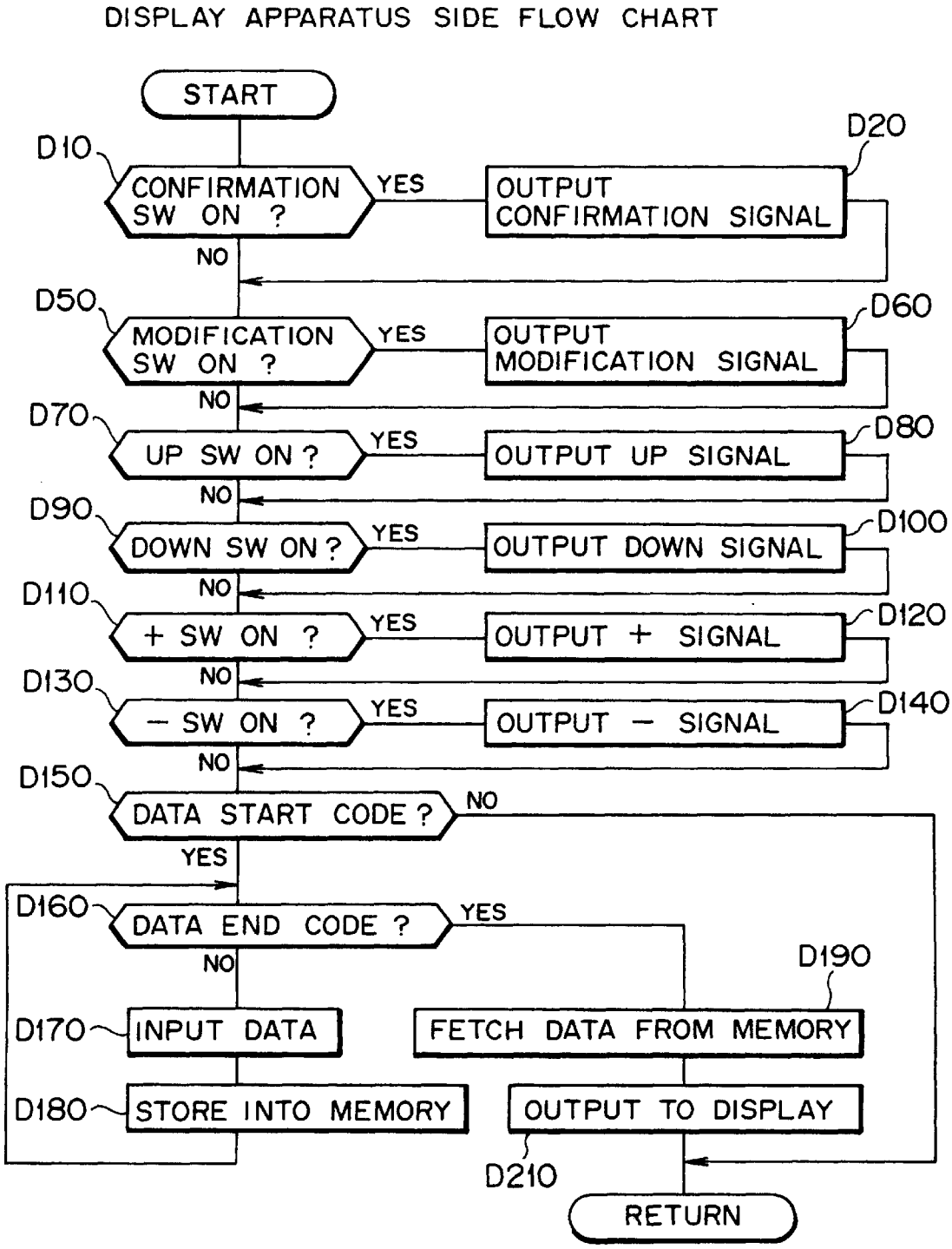
FIG. 8 is a flow chart illustrating processing by a display apparatus in the control apparatus and the control method for a construction machine according to the first embodiment of the present invention.

As shown in FIG. 8, first in step D10, it is discriminated whether or not the confirmation switch 66 is in an ON-state as a result of an operation of the confirmation switch 66 by an operator, and if the confirmation switch 66 is ON, then the control advances to step D20, in which a signal from the confirmation switch 66 is outputted to the controller 12, whereafter the control advances to step D50. On the other hand, if the confirmation switch 66 is not ON, then the control advances directly to step D50. Then, it is discriminated in step D50 whether or not the modification switch 67 is ON.

If a result of the discrimination indicates that the modification switch is ON, then the control advances to step D60, in which a signal from the modification switch 67 is outputted to the controller 12, whereafter the control advances to step D70. On the other hand, if the modification switch 67 is not ON, then the control advances directly to step D70.

Then, it is discriminated in step D70 whether or not the UP switch 68*a* is ON.

If a result of the discrimination indicates that the UP switch 68*a* is ON, then the control advances to step D80, in which a signal from the UP switch 68*a* is outputted to the controller 12, whereafter the control advances to step D90. On the other hand, if the UP switch 68*a* is not ON, the control advances directly to step D90.

Then, it is discriminated in step D90 whether or not the DOWN switch 68*b* is ON.

If a result of the discrimination indicates that the DOWN switch 68*b* is ON, then the control advances to step D100, in which a signal from the DOWN switch 68*b* is outputted to the controller 12, whereafter the control advances to step D110. On the other hand, if the DOWN switch 68*b* is not ON, the control advances directly to step D110.

Then, in step D110, it is discriminated whether or not the +switch 69*a* is ON.

If a result of the discrimination indicates that the +switch 69*a* is ON, then the control advances to step D120, in which a signal from the +switch 69*a* is outputted to the controller 12, whereafter the control advances to step D130. On the other hand, if the +switch 69*a* is not ON, then the control advances directly to step D130.

Then, in step D130, it is discriminated whether or not the −switch 69*b* is ON.

If a result of the discrimination indicates that the −switch 69*b* is ON, then the control advances to step D140, in which a signal from the −switch 69*b* is outputted to the controller 12, whereafter the control advances to step D150. On the other hand, if the −switch 69*b* is not ON, then the control advances to step D150.

It is to be noted that the order of discrimination of ON of the switches may be any other than that described above.

Then, in step D150, it is discriminated whether or not the data start code has been inputted to the CPU 61 of the display apparatus 60. If it is discriminated that the data start code has not been inputted to the CPU 61 of the display apparatus 60, then the control returns.

On the other hand, if it is discriminated that the data start code has been inputted to the CPU 61 of the display apparatus 60, then the control advances to step D160, in which it is discriminated whether or not the data end code has been inputted to the CPU 61 of the display apparatus 60.

If a result of the discrimination indicates that the data end code has not been inputted to the CPU 61 of the display apparatus 60, then the control advances to step D170, in which various data (for example, the code regarding the type of the attachment 2, the data of the default value regarding the operation condition of the attachment 2 and so forth) are inputted from the controller 12. Then in step D180, the inputted various data are stored into the RAM 64 of the display apparatus 60 once, and then the control returns to step D160 again so that the processing is repeated.

On the other hand, if it is discriminated in step D160 that the data end code has been inputted to the CPU 61 of the display apparatus 60, then the control advances to step D190, in which the CPU 61 of the display apparatus 60 successively fetches the data stored in the RAM 64. Then in step D210, the data are outputted to the display unit 65, and the processing is ended.

The control apparatus for a construction machine according to the present embodiment has the following operation and effects since the type of an attachment 2 and a default value regarding an operation condition of the attachment 2 are set in such a manner as described above.

In particular, in a working site, when an attachment 2 is to be attached to the construction machine body 101, the key-type IC memory holder 30 provided in the box 23 provided in the attachment (for example, a breaker) 2 is taken out from the attachment 2.

Then, if the key-type IC memory holder 30 taken out from the attachment 2 is inserted into the key-cylinder type connection section 27 provided for the controller 12 on the construction machine body 101 side, then the unique information of the attachment 2 stored in the IC memory 31 held by the key-type IC memory holder 30 is taken out through the key cylinder type connection section 27 to the controller 12 side, and the operation condition of the attachment 2 is set by the controller 12 using the taken out unique information of the attachment 2. The hydraulic pumps 5 and 6 which form a hydraulic power source are controlled based on the thus set value.

In this manner, in the present embodiment, only by performing simple operations of taking out the key-type IC memory holder 30 provided in the attachment 2 and inserting the key-type IC memory holder 30 into the key cylinder type connection section 27 of the construction machine body 101 side, unique information of the attachment 2 stored in the IC memory 31 held by the key-type IC memory holder 30 is taken out, and an operation condition required by the attachment 2 is set by the controller 12 based on the unique information of the attachment 2. The engine 7 and the hydraulic pumps 5 and 6 are controlled based on the operation condition (controlling step).

In this instance, the display apparatus 60 centers the type display mode, in which the type of the attachment 2 discriminated by the controller 12 is displayed on the display unit 65 of the display apparatus 60.

On the other hand, if unique information of the attachment 2 stored in the IC memory 31 cannot be taken out to the controller 12 side and the type of the attachment 2 cannot be discriminated by the controller 12, then the display apparatus 60 enters the discrimination failure display mode, in which discrimination failure display is performed by the display unit 65 of the display apparatus 60 (displaying step).

When the discrimination failure display is performed in this manner by the display unit 65 of the display apparatus 60, as the operator operates the standard setting value setting switches including the modification switch 67, UP switch 68*a*, DOWN switch 68*b*, +switch 69*a* and −switch 69*b*, a default value (standard set value) corresponding to the attachment 2 attached is set by the controller 12 (standard set value setting step).

Then, the engine 7 and the hydraulic pumps 5 and 6 are controlled by the controller 12 based on the information of the standard set value set in the standard setting value setting step (controlling step).

Figure 9:
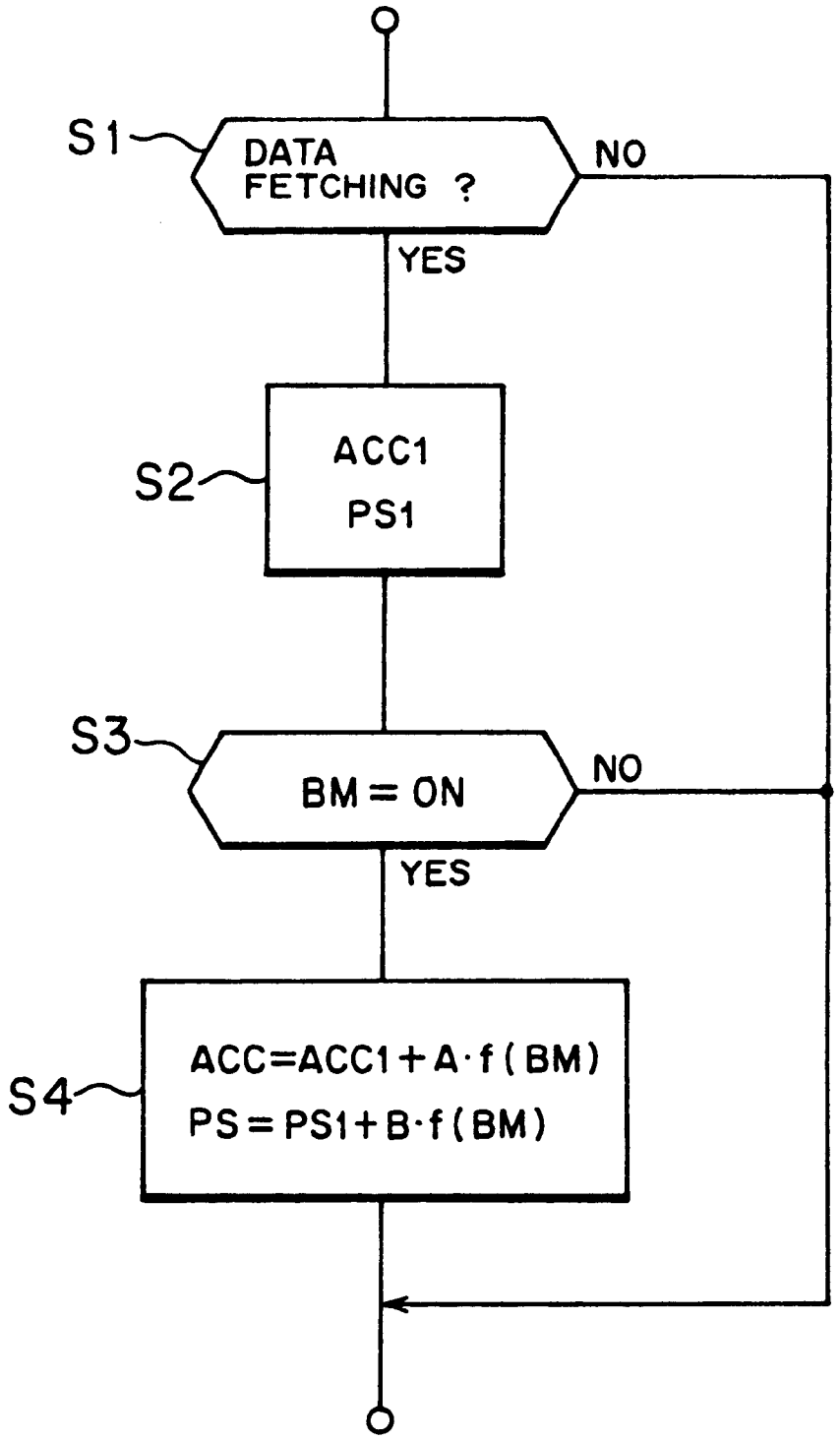
FIG. 9 is a flow chart illustrating a control procedure of a hydraulic pump in the control apparatus and the control method for a construction machine according to the first embodiment of the present invention.

Here, FIG. 9 is a flow chart for illustrating operation when the controller 12 utilizes unique information (accelerator position ACC1 and pump power PS1) fetched from the IC memory 31 held by the key-type IC memory holder 30 or information of a standard set value set by the standard set value setting section as it is in order to operate the attachment 2 or when an accelerator position ACC or a pump power PS is to be calculated when an actuator other than the attachment 2 is to be operated simultaneously with the attachment 2 in order to, for example, press the attachment 2 against a subject.

Here, in the case of simultaneous operation, correction values A·f(BM) and B·f(BM) obtained by multiplying a function f(BM) relating to an operation mount to the boom lowering side of the lever operator 22 which pilot operates the control valve 4 of the boom driving hydraulic cylinder 107 by a fixed accelerator position correction coefficient A and pump power correction coefficient B are added to an accelerator position ACC1 and a pump power PS1 to be used to operate the attachment 2 to calculate modified values ACC and PS, and they are outputted.

Now, the calculation processing method of the controller 11 illustrated in FIG. 9 is described with reference to FIG. 1A.

As shown in FIG. 9, if unique information (accelerator position ACC1, pump power PS1 and so forth) stored in the IC memory 31 held by the key-type IC memory holder 30 or information of a standard set value set by the standard setting value set section is taken out to the controller 12 side (YES in step S1), then the unique information or the information of the standard set value set by the standard set value setting section is stored (step S2), and if the boom driving hydraulic cylinder 107 is in a stopping state (NO in step S3), then the accelerator position ACC1 and pump power PS1 are outputted from the controller 12.

This is described with reference to FIG. 1A. An operation of the attachment 2 is performed by the pedal type operator 21, and by treadling down the pedal type operator 21, a pilot oil pressure corresponding to the treadling operation amount is outputted through the pilot oil paths 29*a* and 29*b*. Consequently, the control valve 3 is pilot operated, and discharge pressure oil of the hydraulic pumps 5 and 6 is supplied to the attachment 2 in accordance with the operation amount of the control valve 3.

In this instance, operation presence signals detected by the pressure switches 24 and 25 from the pilot oil paths 29*a* and 29*b* of the pedal type operator 21 are inputted to the controller 12, and the controller 12 detects that the pedal type operator 21 has been operated. Then, a set value (for example, accelerator position ACC1 or pump power PS1) selected in advance is outputted as an operation condition required by the attachment 2.

An accelerator signal outputted from the controller 12 is inputted to the accelerator actuator 8, and the accelerator position of the engine 7 is controlled. On the other hand, a pump driving signal outputted from the controller 12 is inputted to and converted into oil pressures by the solenoid proportional valves 13 and 14 and then inputted to the pump regulators 9 and 10 so that the powers of the hydraulic pumps 5 and 6 are controlled.

Now, a case wherein another actuator, here, the boom cylinder 107, is operated simultaneously with the attachment 2 is described.

When an attachment 2 is to be used, it is efficient to move the boom 105 downwardly and perform working while the attachment (here, a breaker) 2 is pressed against a subject, and a demand for such an operation is high.

In such an instance, a signal from the pressure sensor 26 provided for the boom lowering side pilot oil path 29*d* of the manual lever type operator 22 which drives the boom driving hydraulic cylinder 107 is inputted to the controller 12.

The pilot oil path 29*d* of the lever type operator 22 is connected to the control valve 4, and drives the control valve 4 so that delivered pressure oil of the hydraulic pumps 5 and 6 is supplied to the boom driving hydraulic cylinder 107 in response to the operation amount of the control valve 4.

Then, when the boom driving hydraulic cylinder 107 is caused to perform a contracting operation (lowering movement of the boom 105), the pump discharge flow rate is increased so that the driving speed of the boom driving hydraulic cylinder 107 corresponding to the signal of the pressure sensor 26 may be obtained.

In particular, as shown in FIG. 9, if the boom driving hydraulic cylinder 107 is operated simultaneously with the attachment 2 (YES in step S3), then A·f(BM) which is an increased amount of the accelerator position is added to the accelerator position ACC1 selected in step S2 to calculate a modified accelerator position ACC, and B·f(BM) which is an increased amount of the pump power is added to the pump power PS1 selected in step S2 to calculate a modified pump power PS (step S4). It is to be noted that A and B are increase coefficients, and f(BM) is a function of the operation amount of the pedal type operator 22.

As the modified values (ACC and PS) determined by correction calculation in this manner are outputted from the controller 12, the pump discharge flow rate increases, and simultaneous operations of the attachment 2 and the boom driving hydraulic cylinder 107 can be performed.

Accordingly, with the control apparatus and the control method for a construction machine according to the present invention, there is an advantage that, when unique information of an attachment 2 attached to the construction machine body 101 cannot be inputted to the controller 12 and the controller 12 cannot discriminate the type of the controller 12, although discrimination failure display is performed by the display unit 65 of the display apparatus 60, even in this instance, a default value regarding an operation condition suitable for the attached attachment 2 can be set by a simple operation and with certainty by the controller 12 which functions as a standard set value setting section.

Consequently, the hydraulic pumps 5 and 6 can be controlled based on information of the default value, and the attachment 2 can be operated in an appropriate operation condition.

Further, since it can be confirmed by an operation of the confirmation switch 66 that a correct operation condition of the attachment 2 has been set and control of the hydraulic pumps 5 and 6 is started after a switch operation by the confirmation switch 66 is confirmed by the controller 12, there is another advantage that, even if the type of the attachment 2 is discriminated in error because of disconnection or the like, inappropriate control of the hydraulic pumps 5 and 6 can be prevented from being performed.

Furthermore, there is a further advantage that, since a default value can be changed by the modification switch 67, UP switch 68*a*, DOWN switch 68*b*, +switch 69*a* or −switch 69*b* which forms default value changing means, a further suitable operation condition to the attachments 2 attached to the construction machine body 101 can be set.

Further, since a default value is selected in accordance with a priority order, there is a still further advantage that setting of a default value by the operator can be performed smoothly.

Further, since unique information of the attachment 2 stored in the IC memory 31 of the key-type IC memory holder 30 can be fetched only by performing simple operations of removing the key-type IC memory holder 30 provided in the attachment 2 and inserting the key-type IC memory holder 30 into the key cylinder type connection section 27 of the construction machine body 101 side, there is a yet further advantage that unique information relating to an operation condition required by the attachment 2 can be inputted to the controller 12 easily and with certainty without mistaking a corresponding relationship.

It is to be noted that, while, in the control apparatus and the control method for a construction machine according to the first embodiment described above, an IC memory is held by the key-type IC memory holder, the element for holding an IC memory is not limited to this, and a card type IC memory holder may be used. In this instance, it is a matter of course that the connection portion of the construction machine body 101 side must be constructed such that a card type IC memory holder can be inserted into the connection portion.

(B) Description of the Second Embodiment

Subsequently, a control apparatus and a control method for a construction machine according to a second embodiment are described with reference to FIGS. 10 and 11. It is to be noted that, in FIGS. 10 and 11, like reference symbols to those of FIGS. 1A and 2 denote like members.

Figure 10:
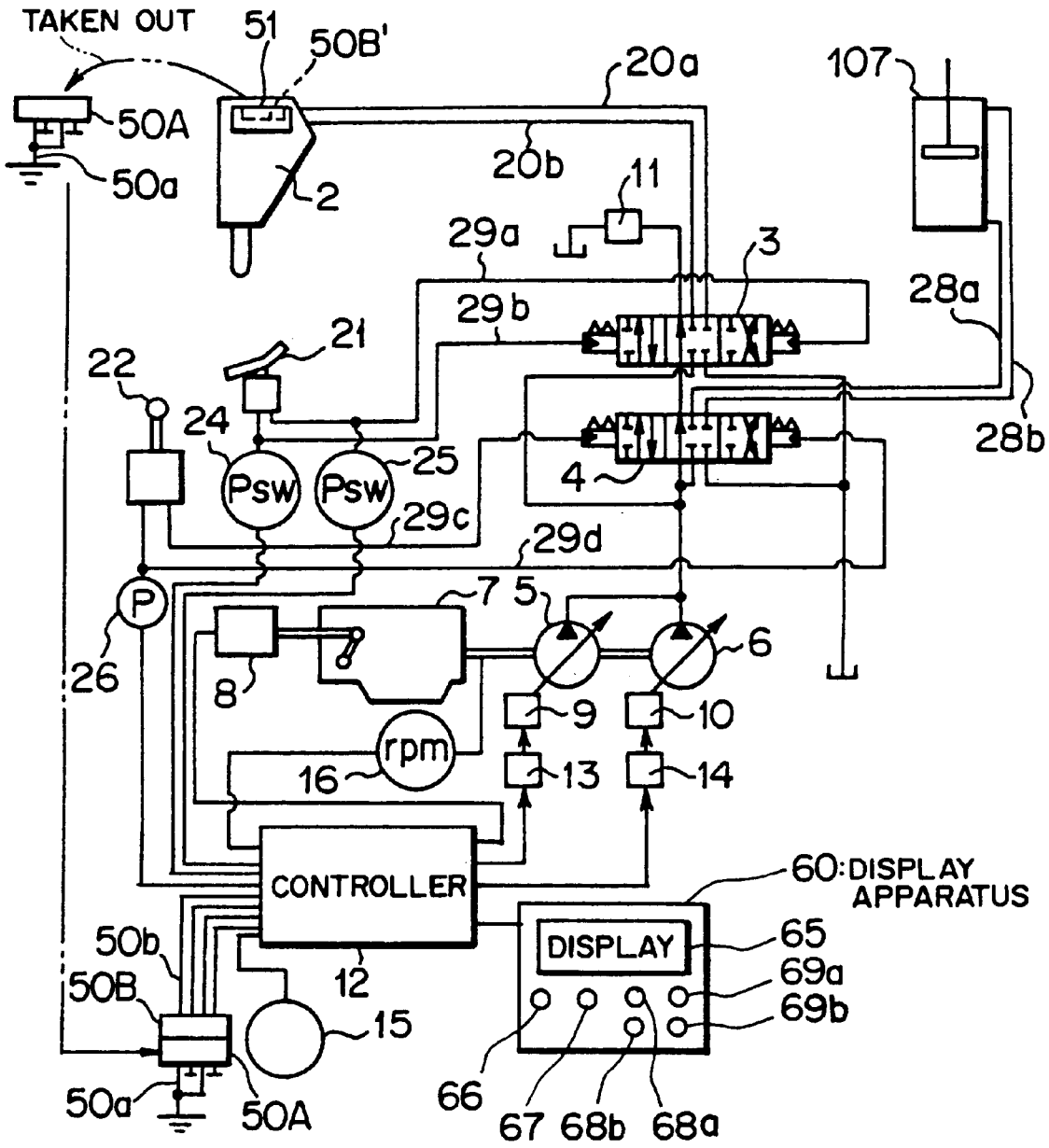
FIG. 10 is a schematic view showing an entire construction of a control apparatus and a control method for a construction machine according to a second embodiment of the present invention.
Figure 11:
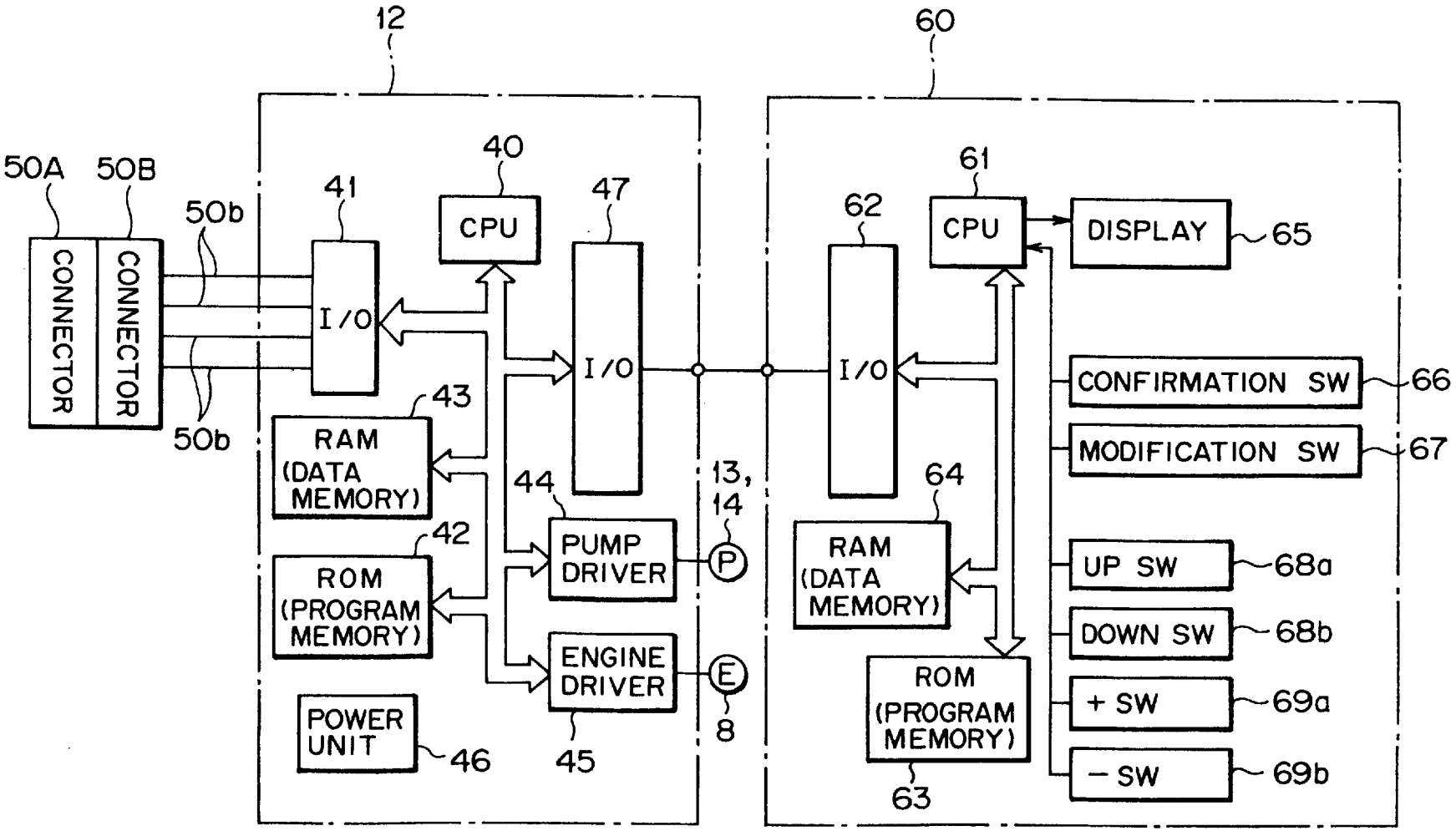
FIG. 11 is a control block diagram of the control apparatus and the control method for a construction machine according to the second embodiment of the present invention.

The control apparatus and the control method for a construction machine according to the present embodiment are different from those of the first embodiment in the uniform information storage member as shown in FIG. 10.

In particular, a male or female type connector 50A as a unique information storage member is removably provided in an attachment 2 according to the present embodiment. In particular, the attachment 2 has a female or male type connector 50B provided thereon, and the connector 50A is removably provided on the connector 50B'.

It is to be noted that the connector 50B' has a cover member 51 provided thereon so that the connector 50B' and the connector 50A may be covered with the cover member 51 in a condition wherein they are connected to each other.

The connector 50A has a plurality of bit terminals 50*a* provided thereon, and a bit pattern unique to each attachment 2 is set depending upon whether or not the plurality of bit terminals 50*a* are grounded.

Since a unique operation condition required by each attachment 2 is set based on a bit pattern unique to the attachment 2 set depending upon whether the plurality of bit terminals 50*a* are grounded or not (1, 0), unique information storage means is formed from the plurality of bit terminals 50*a* and the connector 50A. In the following description, the connector 50A which includes the plurality of bit terminals 50*a* is referred to merely as connector 50A.

It is to be noted that, while, in FIG. 4, only four bit terminals 50*a* are shown, the number of such bit terminals 50*a* is set equal to a number which sufficiently satisfies information of a total number of attachments 2 which can be attached.

On the other hand, a female or male type connector (connection section) 50B with a harness 50*b* for connecting the connector 50A to the controller 12 is provided on the controller 12 of the construction machine body 101 side.

When the connector 50A is connected to the connector 50B with a harness 50*b*, a bit pattern unique for each attachment 2 is set depending upon whether the plurality of bit terminals 50*a* of the connector 50A are grounded or not (1, 0).

The type of the attachment 2 and so forth are discriminated by the controller 12 based on the bit pattern set in this manner, and set values of a pressure, a flow rate and so forth corresponding to the attachment 2 to be used are selected from among set values of a pressure, a flow rate and so forth stored in the controller 12 for each attachment 2 and a unique operation condition (a supply oil pressure, flow rate or the like) required by the attachment 2 is set to control the hydraulic pumps 5 and 6.

Further, the controller 12 of the present embodiment further includes a function (default value setting section, standard set value setting section) of setting a type of an attachment 2 and a standard set value (default value) regarding an operation condition of the attachment 2 when discrimination failure display is performed by the display apparatus 60 in a similar manner as in the first embodiment described hereinabove.

And, when discrimination failure display is performed by the display apparatus 60, the controller 12 controls the hydraulic pumps (oil pressure source) 5 and 6 based in the information of the default value set by the default value setting section.

It is to be noted that the other construction is similar to that of the first embodiment described hereinabove, and therefore, description of it is omitted here.

Since the control apparatus for a construction machine according to the present embodiment is constructed in such a manner as described above, the following operation and effects can be achieved.

In particular, in a working site, when an attachment 2 is to be attached to the construction machine body 101, the connector 50A connected to the connector 50B of the attachment (for example, a breaker) 2 side is removed from the attachment 2.

Then, the connector 50A removed from the attachment 2 side is connected to the connector 50B with a harness 50*b* provided for the controller 12 of the construction machine body 101 side, and thereupon, a bit pattern, as unique information is set for each attachment 2 depending upon whether the plurality of bit terminals 50*a* are grounded or not (1, 0).

Then, a set value (an accelerator position of the engine or a pump set power) is selected based on the bit pattern by the controller 12, whereby an operation condition required by the attachment 2 is set.

On the other hand, if unique information of the attachment 2 attached to the construction machine body 101 cannot be inputted to the controller 12 and the controller 12 fails to discriminate the type of the attachment 2, then discrimination failure display is performed by the display unit 65 of the display apparatus 60. Also in this instance, however, the type of the attachment 2 and a standard set value (default value) regarding an operation condition of the attachment 2 are set by the controller 12 which functions as a standard set value setting section in a similar manner to that described in detail hereinabove in connection with the first embodiment described above.

Accordingly, there is an advantage that a default value regarding an operation condition suitable to the attached attachment 2 can be set by a simple operation and with certainty similarly as in the first embodiment described hereinabove. Consequently, the engine 7 and the hydraulic pumps 5 and 6 can be controlled based on the information of the default value and the attachment 2 can be operated in an appropriate operation condition.

Further, since, by performing simple operations of removing the connector 50A provided for the attachment 2 and connecting the connector 50A to the connector 50B with a harness 50*b* of the construction machine body 101 side, a bit pattern as unique information for each attachment 2 is set depending upon whether the plurality of bit terminals 50*a* are grounded (1, 0) and the type of the attachment 2 is discriminated based on the bit pattern and then an operation condition required by the attachment 2 to be used is set, there is another advantage that an operation condition required by the attachment 2 can be set to the controller 12 readily and with certainty without mistaking a corresponding relationship similarly as in the case of the first embodiment described hereinabove.

It is to be noted that, since, in the first and second embodiments described above, a key type IC memory holder, a card type IC memory holder or the connector 50A having the plurality of bit terminals 50*a* as a unique information storage member is removably attached to an attachment 2 and there is the possibility that it may be lost, in either case, a spare key type IC memory holder or card type IC memory holder of the same type or a spare connector 50A having a plurality of bit terminals 50*a* may be stored at a separate storage place, and if the IC memory holder or the connector of the attachment 2 side is lost, the spare one may be used.

(C) Description of the Third Embodiment

Subsequently, a control apparatus and a control method for a construction machine according to a third embodiment of the present invention are described with reference to FIGS. 12 and 13. It is to be noted that, in FIGS. 12 and 13, like reference symbols to those of FIGS. 1A and 2 denote like members.

Figure 12:
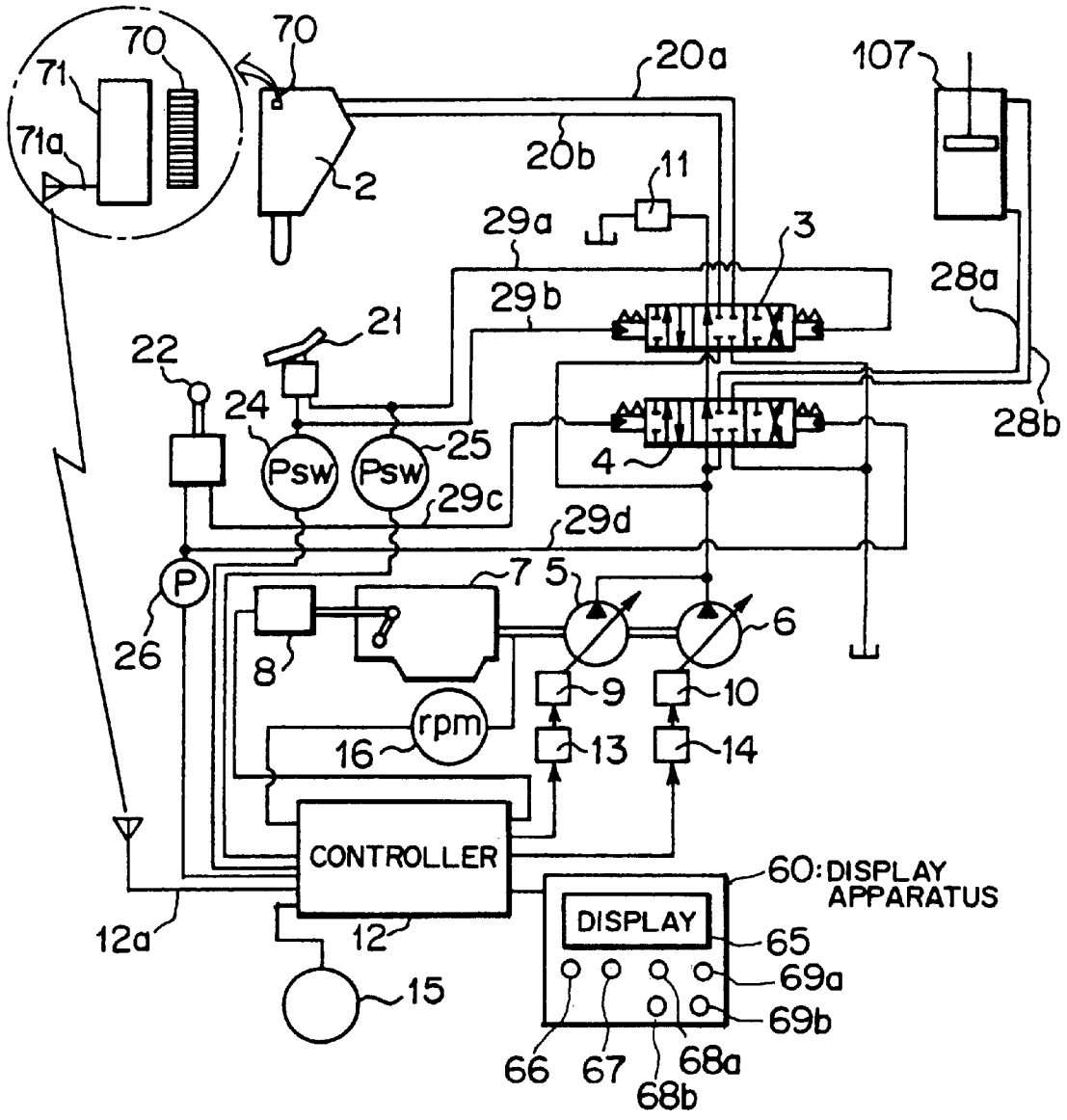
FIG. 12 is a schematic view showing an entire construction of a control apparatus and a control method for a construction machine according to a third embodiment of the present invention.

The control apparatus and the control method for a construction machine according to the present embodiment are different in the unique information storage member from those of the first embodiment as shown in FIG. 12.

In particular, an attachment 2 according to the present embodiment has a bar code 70 provided thereon as a unique information storage member.

In the bar code 70, unique information for setting an operation condition required by the attachment 2 is stored as binary information. In particular, the bar code 70 usually includes a plurality of bars of black (hereinafter referred to as black bars) and bars of white (hereinafter referred to as white bars) disposed alternately and represents predetermined data based on widths of the black bars and the white bars.

On the other hand, the construction machine body 1 has a bar code reader 71 as a bar code reading unit provided in the operator cab 103 thereof such that binary information of the bar code 70 provided on an attachment 2 can be read by a manual operation by means of the bar code reader 71.

The bar code reader 71 irradiates scanning light upon the bar code 70 and receives light reflected from the bar code 70 and having the binary information to read the binary information of the bar code 70, and transmits the binary information by radio communication to the controller 12.

Figure 13:
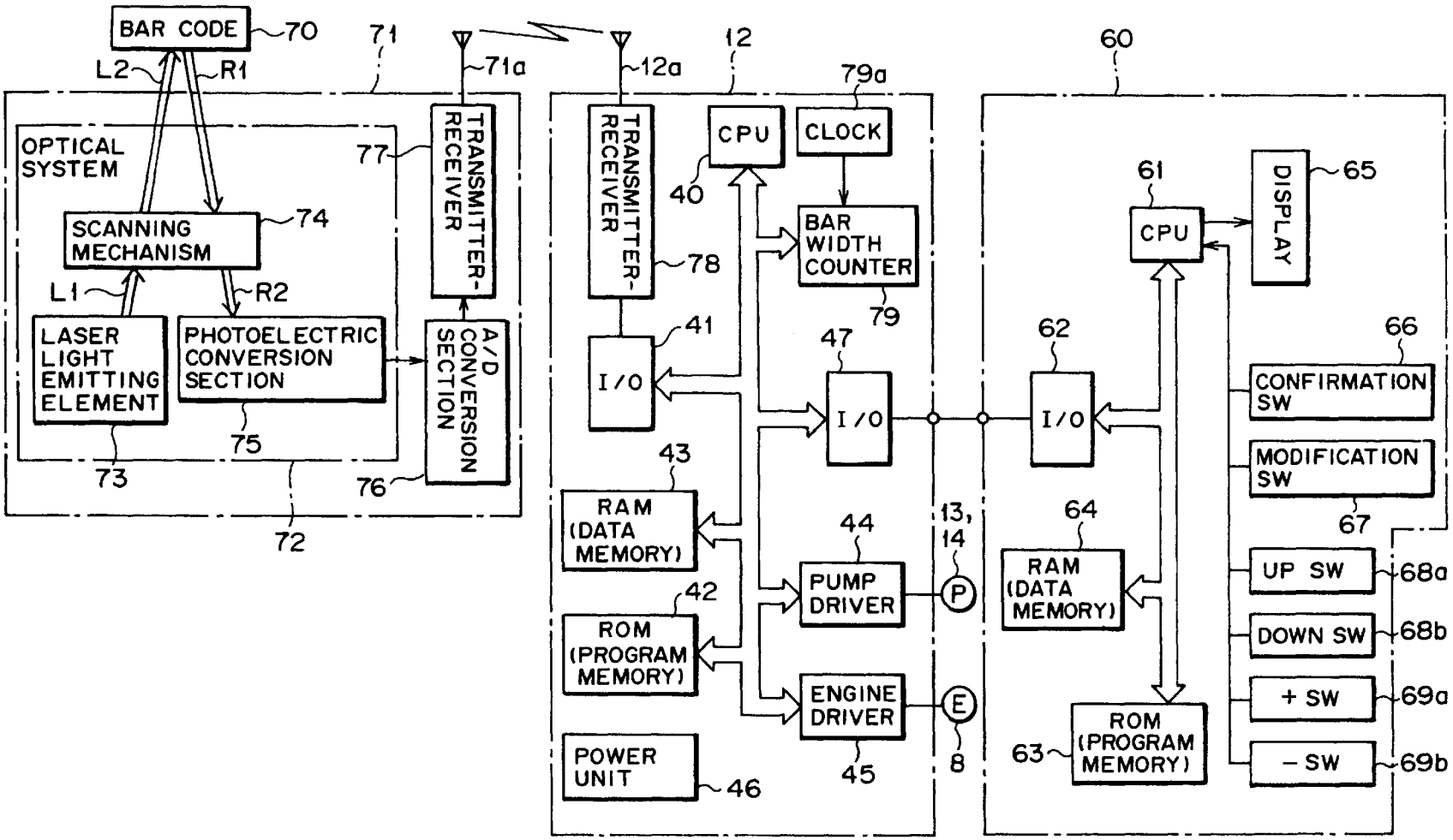
FIG. 13 is a control block diagram of the control apparatus and the control method for a construction machine according to the third embodiment of the present invention.

The hardware construction of the bar code reader 71 includes, for example, as shown in FIG. 13, an optical system 72, an A/D conversion section 76 and a transmitter-receiver 77.

The optical system 72 irradiates a laser beam L2 upon the bar code 70 and receives reflected light R1 of the laser beam L2 reflected from the bar code 70. The optical system 72 is composed of a laser light emitting element 73, a scanning mechanism 74 and a photoelectric conversion section 75.

Here, the laser light emitting element 73 includes a semiconductor laser which emits a laser beam L1.

The scanning mechanism 74 is formed from a polygon mirror which is driven to rotate, for example, by a motor, and has a function of reflecting the laser beam L1 from the laser light emitting element 73 to irradiate the laser beam L1 upon the plurality of black bars and white bars, which form the bar code 70, while moving the laser beam L1 at a fixed speed in a direction perpendicular to the black bars and white bars of the bar code 70 to scan them.

The scanning mechanism 74 has a function of reflecting reflected light R1 of the laser beam L2 from the bar code 70 so that the reflected light R1 which is moved by scanning of the laser beam L2 is introduced as reflected light R2 into the photoelectric conversion section 75.

Further, the photoelectric conversion section 75 includes a photoelectric conversion element such as, for example, a photodiode, and converts reflected light R2 (an optical input signal) received through the scanning mechanism 74 into an electric signal (analog value) corresponding to an amount of the light and outputs it.

The A/D conversion section 76 digitizes an electric signal from the photoelectric conversion section 75. The A/D conversion section 76 digitizes an electric signal from the photoelectric conversion section 75 to converting into a binary signal including a black level signal corresponding to each black bar portion of the bar code 70 and a white level signal corresponding to each white bar portion of the bar code 70.

As the binary signal, since usually the amount of light of the reflected light R2 from each white bar portion is greater than the amount of light of the reflected light R2 from each black bar portion, a signal wherein the white level signal has a High level and the black level signal is a Low level signal is obtained. The transmitter-receiver 77 is a radio transmitter-receiver serving as transmission means which performs transmission and reception to and from a transmitter-receiver 78 of the controller 12 side by radio communication. It is to be noted that the transmitter-receiver 77 includes a transmission/reception antenna 71*a*.

The controller 12 has such a hardware construction as shown in FIG. 13 so that it may perform transmission and reception to and from the bar code reader 71 having such a construction as described above, extract and demodulate predetermined data from a binary signal of the bar code 70 read by the bar code reader 71, automatically discriminate the type of the attachment 2 and so forth and set an operation condition (a supply oil pressure or flow rate) required by the attachment 2.

In particular, the present controller 12 includes a CPU 40, a transmitter-receiver 78 and a transmission/reception antenna 12*a* serving as transmission means for performing transmission and reception to and from the transmitter-receiver 77 of the bar code reader 71 by radio communication, an I/O 41 connected to the transmitter-receiver 78, a bar width counter 79, a clock generator 79*a*, a ROM 42 in which a processing program is stored, a RAM 43 for storing information (referred to as unique information) of a type, a rate flow rate, a pressure and so forth unique to an individual attachment 2 obtained from the bar code 70, a pump driver 44 for driving the pump regulators 9 and 10 of a hydraulic power source through the solenoid proportional valve 13 and, 14 to control the pump set power, and an engine driver 45 for driving the accelerator actuator 8 of the hydraulic power source to control the speed of the engine 7. It is to be noted that also a power unit 46 for operating the controller 12 is provided in the controller 12.

Of the components described above, the bar width counter 79 counts clock signals from the clock generator 79*a*.

The bar width counter 79 outputs a value corresponding to the time width of each of black signal portions and white signal portions of a binary signal of the bar code 70, that is, the width of each of the black bars and the white bars of the actual bar code 70, as a count value of the clock signals. To this end, a binary signal of the bar code 70 received through the transmission/reception antenna 12*a* and the transmitter-receiver 78 is inputted to the bar width counter 79 through the I/O 41 and a bus line.

The bar width count value by the bar width counter 79 is stored into the RAM 43. Then, the CPU 40 extracts and demodulates, based on bar width count values (values corresponding to the widths of the black bars and the white bars) stored in the RAM 43, unique information of the attachment 2 the bar code 70 has.

Further, the CPU 40 performs communication of data with the ROM 42 and the RAM 43 over the bus line, discriminates the type of the attachment 2 and so forth based on the extracted and modulated unique information of the attachment 2, and sets an operation condition (a supply oil pressure and/or flow rate) required by the attachment 2.

Further, the controller 12 of the present embodiment has a function (default value setting section, standard set value setting section) of setting the type of the attachment 2 and a standard set value (default value) regarding an operation condition of the attachment 2 when discrimination failure display is performed by the display apparatus 60 similarly as in the first embodiment described hereinabove.

Then, when discrimination failure display is performed by the display apparatus 60, the controller 12 controls the engine 7 and the hydraulic pumps (hydraulic power sources) 5 and 6 based on the information of the default value set by the default value setting section.

It is to be noted that, since the other construction is similar to that of the first embodiment described hereinabove, description of it is omitted here.

Since the control apparatus for a construction machine according to the present embodiment is constructed in such a manner as described above, the following operation and effects are achieved.

In particular, in a working site, when an attachment 2 is to be attached to the construction machine body 101, scanning light is irradiated upon the bar code 23 provided on the attachment 2 (for example, a breaker) using the bar code reader 30 and light reflected from the bar code 23 and having binary information is received to read the binary information of the bar code 23.

The binary information of the bar code 23 read by the bar code reader 30 in this manner is sent to the controller 12 by radio communication. The controller 12 selects a set value (an accelerator position of the engine and/or a pump set power) based on the unique information of the attachment as the binary information to set an operation condition required by the attachment 2, and the engine 7 and the hydraulic pumps 5 and 6 which form a hydraulic power source are controlled based on the set values.

In this manner, in the present embodiment, an operation condition required by the attachment 2 is set to the controller 12 only by performing such a simple operation of reading unique information of the attachment 2 stored as binary information on the bar code 23 provided on the attachment 2 by means of the bar code reader 3.

Then, if unique information of the attachment 2 attached to the construction machine body 101 cannot be inputted to the controller 12 and the controller 12 fails to discriminate the type of the attachment 2, then discrimination failure display is performed by the display unit 65 of the display apparatus 60. Also in this instance, however, the type of the attachment 2 and a standard set value (default value) regarding an operation condition of the attachment 2 are set by the controller 12 which functions as a standard set value setting section in a similar manner to that described in detail hereinabove in connection with the first embodiment described above.

Accordingly, there is an advantage that a default value regarding an operation condition suitable to the attached attachment 2 can be set by a simple operation and with certainty similarly as in the first embodiment described hereinabove. Consequently, the engine 7 and the hydraulic pumps 5 and 6 can be controlled based on the information of the default value and the attachment 2 can be operated in an appropriate operation condition.

Further, since unique information of the working attachment stored in the unique information storage member can be fetched only by performing such a simple operation of reading binary information of the bar code 23 provided on the attachment 2 by means of the bar code reader 30, there is an advantage also in that unique information relating to an operation condition required by the attachment 2 can be inputted to the controller 12 readily and with certainty without mistaking a corresponding relationship.

It is to be noted that, while, in the control apparatus and the control method for a construction machine of the present embodiment, the bar code reader 30 is provided in the operator cab 103 and information of the bar code 23 is read by a manual operation and then communication between the bar code reader 30 and the controller 12 is performed by radio communication, the communication between the bar code reader 30 and the controller 12 may be performed by wire communication. Further, if dust-proof and water-proof can be achieved with certainty, then the bar code reader 30 may be provided in the attachment 2 while the communication between the bar code reader 30 and the controller 12 is performed by radio communication or by wire communication.

Further, while, in the control apparatus and the control method for a construction machine of the present embodiment, the controller 12 includes the bar width counter 43 and the clock 44 and binary information of the bar code 23 is extracted and modulated by the CPU 40, the bar code receiver 30 may be constructed including a CPU, a bar width counter and a clock so that binary information of the bar code 23 may be extracted and demodulated by the bar code receiver 30 side.

Further, while, in the control apparatus and the control method for a construction machine of the present embodiment, before binary information of the bar code 23 is transmitted from the bar code receiver 30 to the controller 12, an electric signal from the IC memory 31 is converted into and transmitted as a digital signal by the A/D conversion section 35, the electric signal may be transmitted as an analog signal from the bar code receiver 30 to the controller 12 whereas it is digitized by the controller 12 side.

(D) Description of the Fourth Embodiment

Subsequently, a control apparatus and a control method for a construction machine according to a fourth embodiment of the present invention are described with reference to FIGS. 14 and 15. It is to be noted that, in FIGS. 14 and 15, like reference numerals to those of FIGS. 1A and 2 denote like members.

Figure 14:
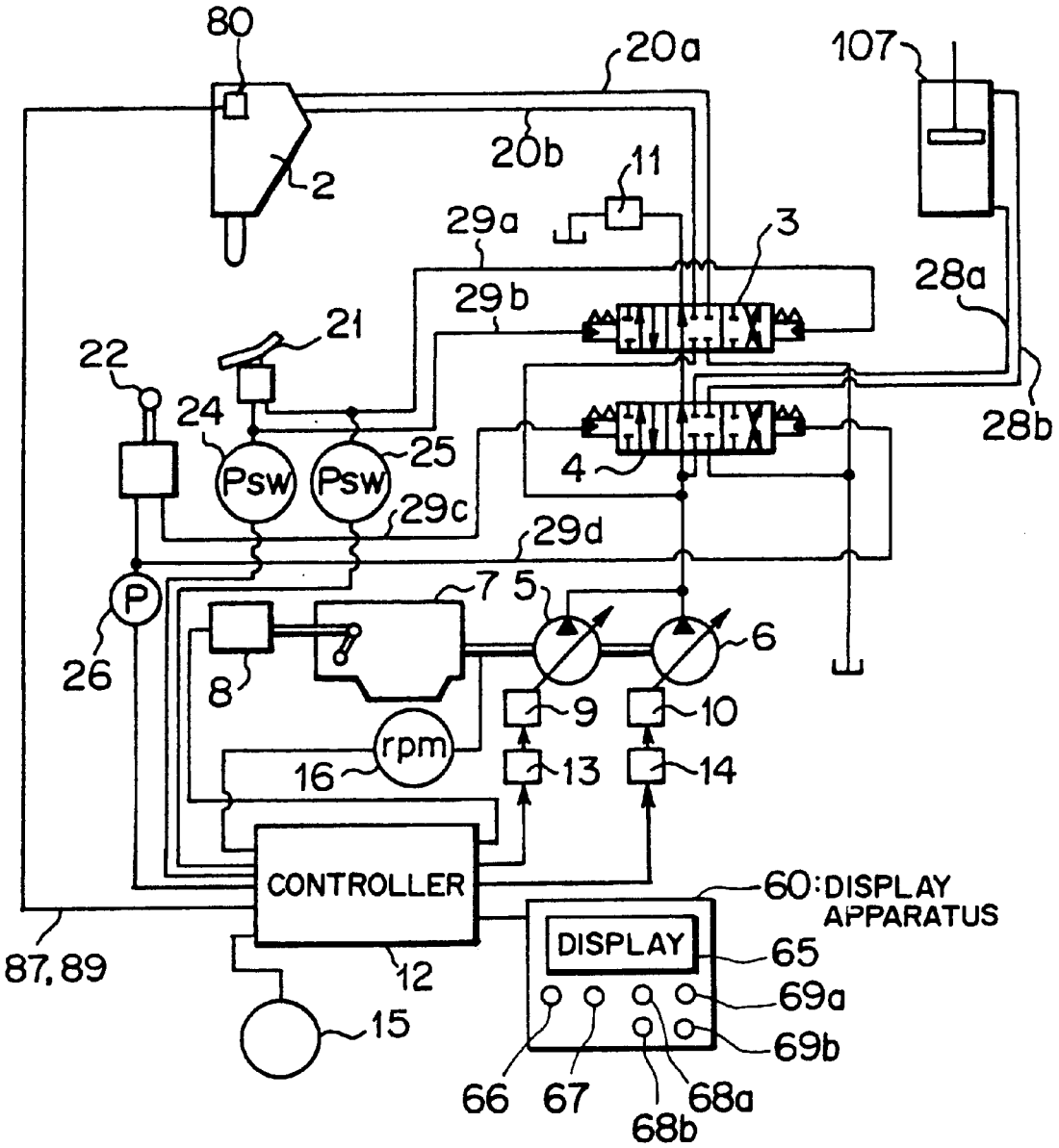
FIG. 14 is a schematic view showing an entire construction of a control apparatus and a control method for a construction machine according to a fourth embodiment of the present invention.
Figure 15:
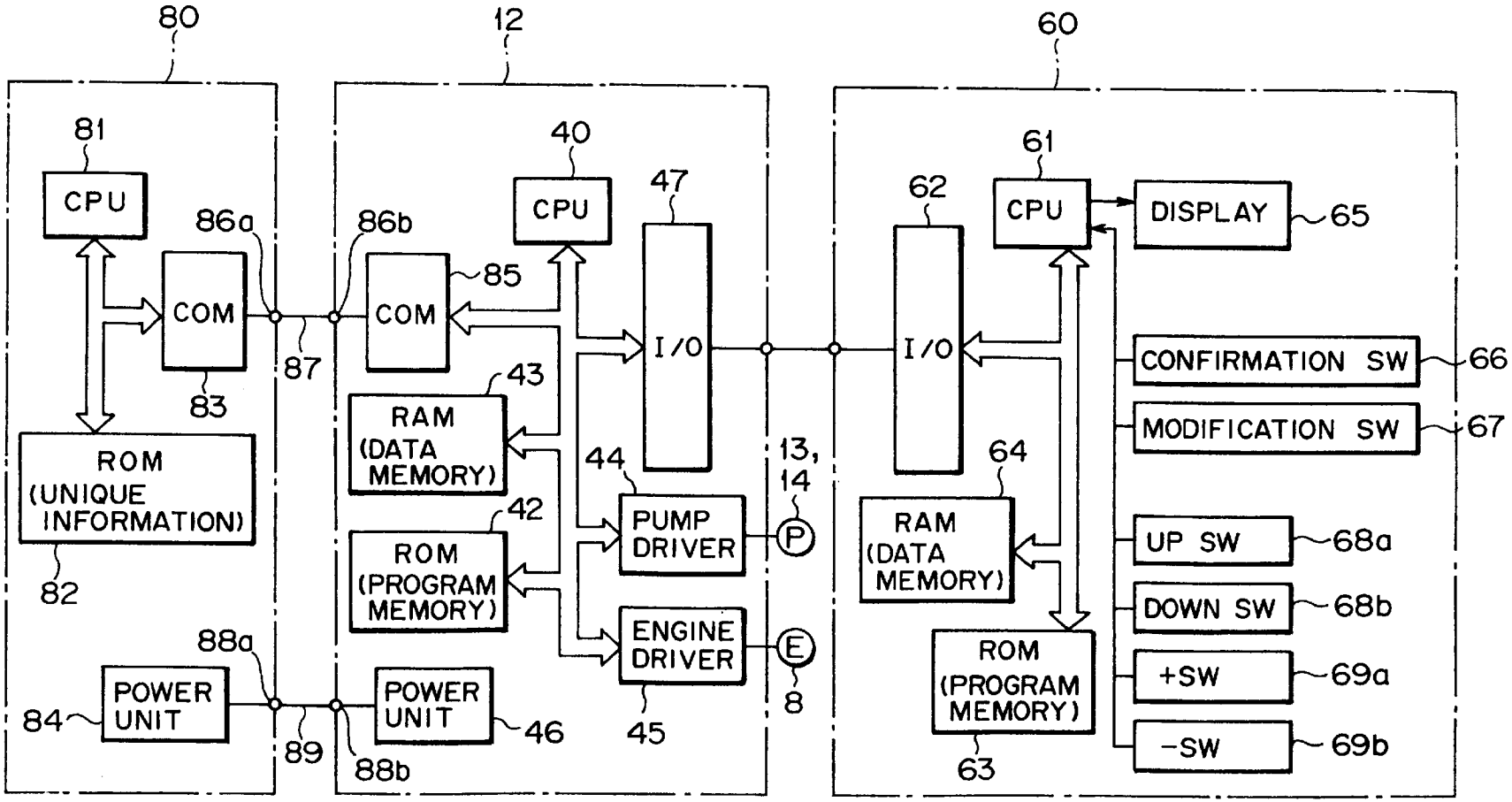
FIG. 15 is a control block diagram of the control apparatus and the control method for a construction machine according to the fourth embodiment of the present invention.

The control apparatus and the control method for a construction machine according to the present embodiment are different in the unique information storage member from those of the first embodiment as shown in FIGS. 14 and 15.

In particular, in the present embodiment, an attachment 2 has a transmitter 80 provided there on as a unique information storage member.

The hardware construction of the transmitter 80 includes, as shown in FIG. 15, a ROM 82 serving as a data storage apparatus for storing unique information of an attachment 2, a CPU 81 for performing fetching processing of the unique information from the ROM 82, a data communication interface (hereinafter referred to as COM) 83 serving as transmission means for receiving a fetching instruction signal from the controller 12 of the construction machine body 101 side to the CPU 81 by wire communication and transmitting unique information fetched from the ROM 82 by the CPU 81 to the controller 12 of the construction machine body 101 side by wire communication, and a power unit 84 for receiving power supply from the power unit 46 of the controller 12 of the construction machine body 101 side.

Meanwhile, the controller 12 of the construction machine body 101 includes a COM 85 serving as transmission means for performing serial communication with the transmitter 80 of the attachment 2. It is to be noted that the other construction is similar to that of the first embodiment described hereinabove.

When an attachment 2 is attached to the construction machine body 101, the power unit 46 of the controller 12 of the construction machine body 101 and the power unit 84 of the transmitter 80 of the attachment 2 are connected to each other by a power supply cable 89 and connectors 88*a* and 88*b*, and the COM 85 of the controller 12 and the COM 83 of the transmitter 80 are connected to each other by wire connection means including a communication cable 87 and connectors 86*a* and 86*b*.

The controller 12 of the present embodiment further has a function (default value setting section, standard set value setting section) of setting the type of an attachment 2 and a standard set value (default value) regarding an operation condition of the attachment 2 when discrimination failure display is performed by the display apparatus 60.

If discrimination failure display is performed by the display apparatus 60, then the controller 12 controls the engine 7 and the hydraulic pumps (hydraulic power source) 5 and 6 based on the information of the default value set by the default value setting section.

It is to be noted that, since the other construction is similar to that of the first embodiment described hereinabove, description of it is omitted here.

Since the control apparatus for a construction machine according to the present embodiment is constructed in such a manner as described above, the following operation and effects are achieved.

In particular, in a working site, when an attachment 2 is attached to the construction machine body 101, the transmitter 80 is connected to the controller 12 of the construction machine body 101 through the power supply cable 89 and the communication cable 87. Consequently, power is supplied from the power unit 46 of the controller 12 to the power unit 84 of the transmitter 80 of the attachment 2 so that the transmitter 80 is rendered operative.

Then, the controller 12 outputs a data fetching instruction to the transmitter 80 from the COM 85 by program processing wherein instructions stored in the ROM 42 are successively processed by the CPU 40.

In the meantime, the transmitter 80 reads the instruction by means of the COM 83 and sends it to the CPU 81, and data (unique information of the attachment 2) stored in the ROM 82 are successively read out by program processing of the CPU 81 and transmitted to the COM 85 of the controller 12 from the COM 83.

It is to be noted that, in this instance bidirectional serial communication is performed over the single communication cable 87, and transmission of the data fetching instruction from the controller 12 to the transmitter 80 and transmission of the unique information from the transmitter 80 to the controller 12 are performed by wire communication.

Then, the data regarding the unique information of the attachment 2 thus transmitted are stored into the RAM 43 of the controller 12 by program processing of the CPU 40 of the controller 12.

On the other hand, if the unique information of the attachment 2 attached to the construction machine body 101 cannot be inputted to the controller 12 and the controller 12 cannot discriminate the type of the controller 12, then discrimination failure display is performed by the display 65 of the display apparatus 60. Also in this instance, the type of the attachment 2 and a standard set value (default value) regarding an operation condition of the attachment 2 are set by the controller 12 which functions as a standard set value setting section in a similar manner as described in detail in connection with the first embodiment described hereinabove.

Accordingly, there is an advantage that, similarly as in the first embodiment described hereinabove, a default value regarding an operation condition suitable for an attached attachment 2 can be set by a simple operation and with certainty. Consequently, the engine 7 and the hydraulic pumps 5 and 6 can be controlled based on the information of the default value, and the attachment 2 can be operated in an appropriate operation condition.

(D1) First Modification to the Fourth Embodiment

In the following, a first modification to the fourth embodiment is described with reference to FIG. 16. It is to be noted that, in FIG. 16, like reference numerals to those of FIG. 15 denote like members.

The control apparatus and the control method for a construction machine according to the present first modification are different in the construction of the transmitter from that of the fourth embodiment described above as shown in FIG. 16.

In particular, in the present first modification, an attachment 2 has a transmitter 80 provided thereon as a unique information storage member which performs communication of data by radio communication.

Figure 16:
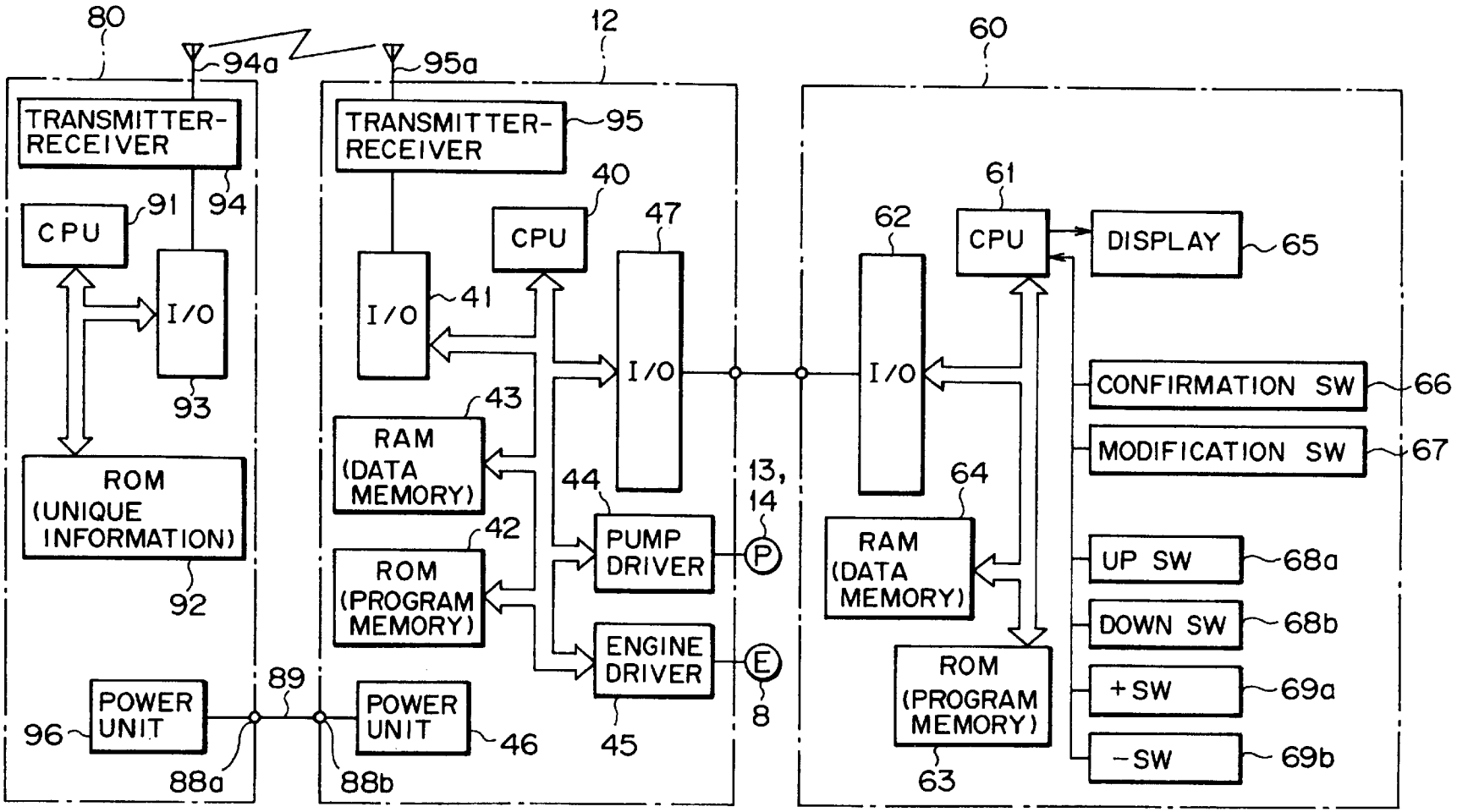
FIG. 16 is a control block diagram of a control apparatus and a control method for a construction machine according to a first modification to the fourth embodiment of the present invention.

The hardware construction of the transmitter 80 includes, as shown in FIG. 16, a ROM 92 serving as a data storage apparatus for storing unique information of an attachment 2, a CPU 91 for performing fetching processing of unique information from the ROM 92 and so forth, a transmitter-receiver 94 and a transmission/reception antenna 94*a* serving as transmission means for performing data communication with the controller 12 of the construction machine body 101 side by radio communication, an I/O 93 connected to the transmitter-receiver 94, and a power unit 96 for receiving power supply from the power unit 46 of the controller 12 of the construction machine body 101 side.

Meanwhile, the controller 12 of the construction machine body 101 includes a transmitter-receiver 95 and a transmission/reception antenna 95*a* which serve as transmission means for performing data communication with the transmitter 80 of the attachment 2 by radio communication. It is to be noted that the other construction is similar to that of the fourth embodiment described hereinabove.

When an attachment 2 is attached to the construction machine body 101, the power unit 46 of the controller 12 of the construction machine body 101 and the power unit 96 of the transmitter 80 of the attachment 2 are connected to each other by a power supply cable 89 and connectors 88*a* and 88*b*.

The controller 12 of the present embodiment has a function (default value setting section, standard set value setting section) of setting the type of the attachment 2 and a standard set value (default value) regarding an operation condition of the attachment 2 when discrimination failure display is performed by the display apparatus 60 similarly as in the fourth embodiment described hereinabove.

If discrimination failure display is performed by the display apparatus 60, then the controller 12 controls the hydraulic pumps (hydraulic power source) 5 and 6 based on the information of the default value set by the default value setting section.

It is to be noted that, since the other construction is similar to that of the fourth embodiment described hereinabove, description of it is omitted here.

Since the control apparatus for a construction machine according to the present first modification is constructed in such a manner as described above, the following operation and effects are achieved.

In particular, in a working site, when an attachment 2 is attached to the construction machine body 101, the transmitter 80 is connected to the controller 12 of the construction machine body 101 through the power supply cable 89, and consequently, power is supplied from the power unit 46 of the controller 12 to the power unit 96 of the transmitter 80 of the attachment 2 so that the transmitter 80 is rendered operative.

Then, the controller 12 transmits a data fetching instruction to the transmitter 80 by radio communication through the transmitter-receiver 95 and the transmission/reception antenna 95*a* by program processing wherein instructions stored in the ROM 42 are successively processed by the CPU 40.

In the meantime, in the transmitter 80, the instruction is received through the transmission/reception antenna 94*a* and the transmitter-receiver 94 and sent to the CPU 91, and data (unique information of the attachment 2*a* stored in the ROM 92 are successively fetched by program processing of the CPU 91 and transmitted to the controller 12 by radio communication through the transmitter-receiver 94 and the transmission/reception antenna 94*a*.

Then, the transmitted data regarding the unique information of the attachment 2 are stored into the RAM 43 of the controller 12 by program processing of the CPU 40 of the controller 12.

On the other hand, if the unique information of the attachment 2 attached to the construction machine body 101 cannot be inputted to the controller 12 and the controller 12 cannot discriminate the type of the attachment 2, then discrimination failure display is performed by the display unit 65 of the display apparatus 60. Also in this instance, the type of the attachment 2 and a standard set value (default value) regarding an operation condition of the attachment 2 are set by the controller 12 which functions as a standard set value setting section in a similar manner as described hereinabove in detail in connection with the first embodiment described hereinabove.

Accordingly, there is an advantage that, similarly as in the first embodiment described hereinabove, a default value regarding an operation condition suitable for the attached attachment 2 can be set by a simple operation and with certainty. Consequently, the engine 7 and the hydraulic pumps 5 and 6 can be controlled based on the information of the default value, and the attachment 2 can be operated in an appropriate operation condition.

(D2) Second Modification to the Fourth Embodiment

In the following, a second modification to, the fourth embodiment is described with reference to FIG. 17. It is to be noted that, in FIG. 17, like reference numerals to those of FIG. 15 denote like members.

The control apparatus and the control method for a construction machine according to the present second modification are different in the construction of the transmitter from that of the fourth embodiment described above.

Figure 17:
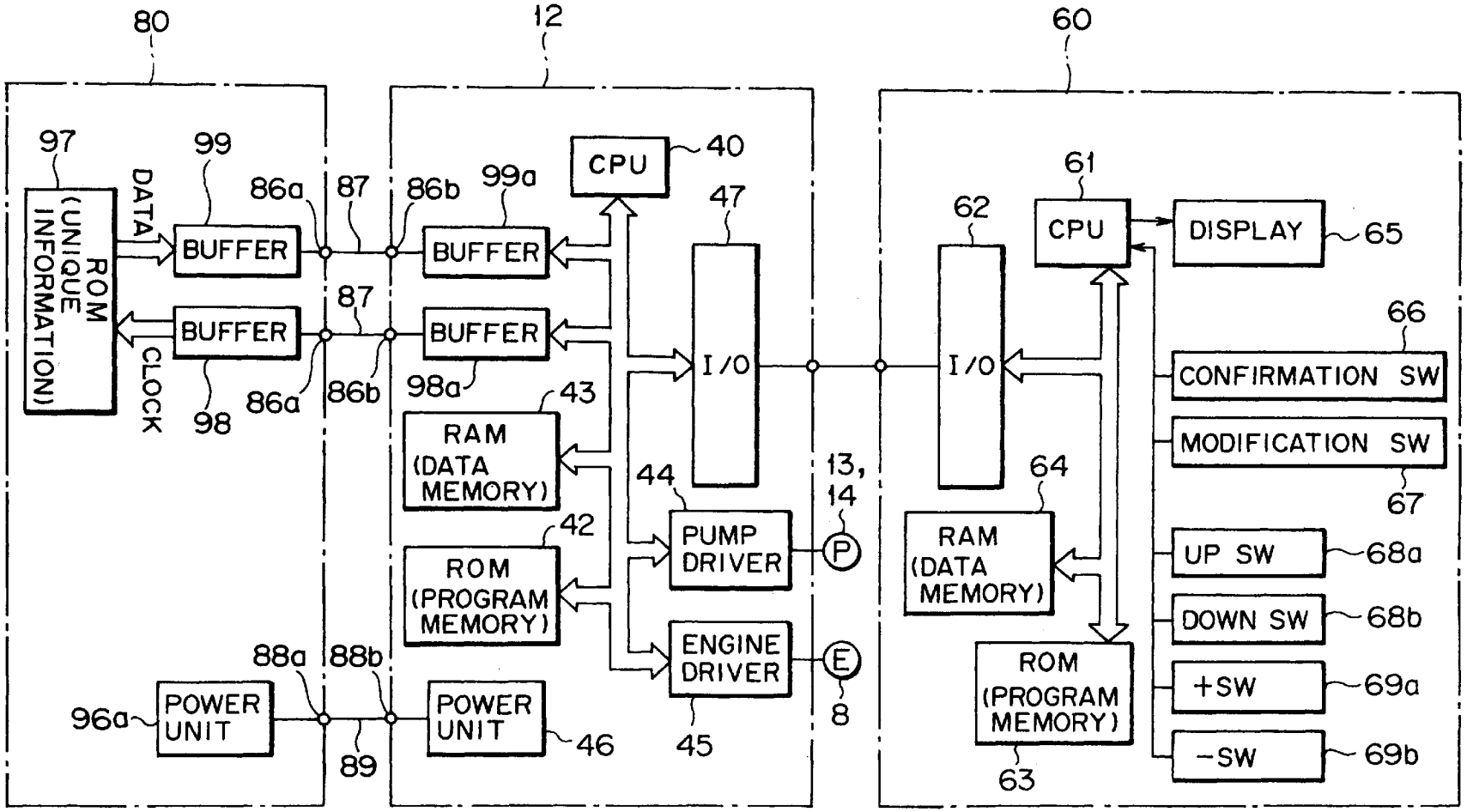
FIG. 17 is a control block diagram of a control apparatus and a control method for a construction machine according to a second modification to the fourth embodiment of the present invention.

In particular, in the present embodiment, the hardware construction of the transmitter 80 includes, as shown in FIG. 17, a ROM 97 serving as a data storage apparatus for storing unique information of an attachment 2, a buffer 98 serving as transmission means for receiving a clockpulse signal from the controller 12 of the construction machine body 101, another buffer 99 serving as transmission means for transmitting unique information in the ROM 97 to the controller 12, and a power unit 96*a* for receiving power supply from the power unit 46 of the controller 12 of the construction machine body 101 side.

It is to be noted that, while, in FIG. 17, only one circuit for transmitting unique information is shown, a required number of circuits for transmitting unique information may be provided in accordance with an amount of information.

Meanwhile, the controller 12 of the construction machine body 101 includes a buffer 98*a* serving as transmission means for transmitting a clock pulse signal to the transmitter 80 of the attachment 2, and another buffer 99*b* serving as transmission means for receiving unique information transmitted from the transmitter 80. It is to be noted that the other construction is similar to that of the fourth embodiment described hereinabove.

When an attachment 2 is attached to the construction machine body 101, the buffers 98*a* and 99*a* of the controller 12 of the construction machine body 101 and the buffers 98 and 99 of the transmitter 80 of the attachment 2 side are connected to each other by a communication cable 87 and connectors 86*a* and 86*b*, and the power unit 46 of the controller 12 of the construction machine body 101 and the power unit 96*a* of the transmitter 80 of the attachment 2 are connected to each other by a power supply cable 89 and connectors 88*a* and 88*b*.

The controller 12 of the present embodiment has a function (default value setting section, standard set value setting section) of setting the type of the attachment 2 and a standard set value (default value) regarding an operation condition of the attachment 2 when discrimination failure display is performed by the display apparatus 60 similarly as in the fourth embodiment described hereinabove.

If discrimination failure display is performed by the display apparatus 60, then the controller 12 controls the hydraulic pumps (hydraulic power source) 5 and 6 based on the information of the default value set by the default value setting section.

It is to be noted that, since the other construction is similar to that of the fourth embodiment described hereinabove, description of it is omitted here.

Since the control apparatus for a construction machine according to the present second modification is constructed in such a manner as described above, the following operation and effects are achieved.

In particular, in a working site, when an attachment 2 is attached to the construction machine body 101, the transmitter 80 is connected to the controller 12 of the construction machine body 101 through the power supply cable 89, and consequently, power is supplied from the power unit 46 of the controller 12 to the power unit 96*a* of the transmitter 80 of the attachment 2 so that the transmitter 80 is rendered operative.

Then, a clock pulse signal is transmitted from the buffer 98*a* of the controller 12 to the buffer 98 of the transmitter 80, and each time this clock pulse signal is transmitted, a pair of data (unique information of an attachment) are fetched from the ROM 97 in the transmitter 80 and inputted to the controller 12 through the buffer 99 and the buffer 99*a*.

By repeating such data fetching, all data are fetched into the controller 12 and stored into the RAM 43 of the controller 12.

On the other hand, if the unique information of the attachment 2 attached to the construction machine body 101 cannot be inputted to the controller 12 and the controller 12 cannot discriminate the type of the attachment 2, then discrimination failure display is performed by the display unit 65 of the display apparatus 60. Also in this instance, the type of the attachment 2 and a standard set value (default value) regarding an operation condition of the attachment 2 are set by the controller 12 which functions as a standard set value setting section in a similar manner as described hereinabove in detail in connection with the first embodiment described hereinabove.

Accordingly, there is an advantage that, similarly as in the first embodiment described hereinabove, a default value regarding an operation condition suitable for the attached attachment 2 can be set by a simple operation and with certainty. Consequently, the engine 7 and the hydraulic pumps 5 and 6 can be controlled based on the information of the default value, and the attachment 2 can be operated in an appropriate operation condition.

(E) Others

It is to be noted that, while, in the control apparatus and the control method for a construction machine according to the various embodiments described above, the display apparatus 60 is constructed including the CPU61, ROM 63, RAM 64 and so forth, the display apparatus is not limited to this, and functions of them may all be provided by the CPU 40, ROM 42, RAM 43 and so forth of the controller 12.

Further, while, in the embodiments described above, the controller 12 serving as a control section has a function (standard set value setting function) of setting a default value regarding an operation condition of an attachment 2, the element having this function is not limited to this, and for example, the standard set value setting section may be provided as a function of the display apparatus 60 side.

Further, while, in the embodiments described above, a plurality of default values regarding an operation condition required for each attachment 2 are provided in the ROM 42 of the controller 12 in advance, the manner of provision of the plurality of default values is not limited to this, and for example, an element like a master key which includes an IC memory in which a plurality of default values regarding an operation condition of each attachment 2 are stored is prepared such that, when discrimination failure display is performed on the display unit 65 of the display apparatus 60, the plurality of default values regarding the operation condition of each attachment 2 are inputted to the controller 12 using the master key.

Further, while it is described that, in the control apparatus and the control method for a construction machine according to the embodiments described above, a discrimination failure display is displayed on the display unit 65 of the display apparatus 60, for example, a lamp may be lit as a discrimination failure display.

Further, while, in the embodiments described above, the confirmation switch 66 is provided, the confirmation switch need not be provided if control of an oil pressure source under wrong settings can be prevented with certainty.

Further, while, in the embodiments described above, a plurality of default values are provided as default values of an attachment 2 such that a default value suitable for an attached attachment 2 can be selected from among the plurality of default values by the UP switch 68*a* and the DOWN switch 68*b* serving as standard set value changing means, a single default value may be provided as a default value of an attachment 2 without allowing selection.

Further, while, in the embodiments described above, a default value of an attachment 2 can be modified to a value suitable for the attached attachment 2 by the +switch 69*a* and the –switch 69*b* serving as standard set changing means, it may not be modified.

Further, while, in the embodiments described above, codes regarding types of an attachment 2 and data of default values regarding an operation condition of the attachment 2 are outputted one by one from the controller 12 to the display apparatus 60 and the types of the attachment 2 or the default values regarding the operation condition of the attachment 2 are displayed one by one on the display unit 65 of the display apparatus 60, the manner in which the codes regarding the types of the attachment 2 and the data of the default values regarding the operation conditions of the attachment 2 are outputted to the display apparatus 60 and the manner in which the types of the attachment 2 and the data of the default values regarding the operation condition of the attachment 2 are displayed on the display unit 65 of the display apparatus 60 are not limited to them.

Further, while, in the embodiments described above, the confirmation switch 66 and the modification switch 67, UP switch 68*a*, DOWN switch 68*b*, +switch 69*a* and –switch 69*b* which serve as standard set value changing means are formed as push-button type switches, the type of the switches is not limited to this, and, for example, switches of the touch type provided on the screen of a display or switches of the lever type may be employed.

Further,in the embodiments described above, a reset switch for performing, when a discrimination failure display is displayed, inputting processing of unique information of an attachment 2 again may be provided such that, against a "discrimination failure" display by the display unit 65 when a type of an attachment 2 cannot be discriminated by the controller 12, inputting processing of unique information of the attachment 2 is enabled again by operating the reset switch 49.

Further, while, in the embodiments described above, various methods are described as an inputting method for unique information of an attachment 2, the inputting method for unique information of an attachment 2 is not limited to them.

Further, the control apparatus and the control methods for a construction machine according to the embodiments described above not only are applied to a construction machine having such a construction as described hereinabove in connection with the various embodiments described above, but can be applied widely to construction machines wherein a working attachment which is driven by supplying working oil from a hydraulic power source is removably attached to a construction machine body.

Industrial Applicability of the Invention

Where the present invention is adopted for a control apparatus and a control method for a construction machine, even if discrimination failure display is performed by a display section when unique information of a working attachment attached to a construction machine body cannot be inputted to a control section and the control section fails to discriminate the type of the working attachment, a standard set value regarding an operation condition suitable for the attached working attachment can be set by a simple operation and with certainty by a standard set value setting section. Consequently, it is considered that a hydraulic power source can be controlled based on information of the standard set value, and the working attachment can be operated in an appropriate operation condition.

What is claimed is:

1. A control apparatus for a construction machine, the construction machine having a working attachment removably attached to a construction machine body and wherein the control apparatus comprises:

a control section for discriminating a type of the working attachment and controlling a hydraulic power source, which supplies working oil to the working attachment, based on unique information for setting an operation condition required by the working attachment in accordance with the type;

a display section for displaying the type of the working attachment discriminated by said control section and performing discrimination failure display when said control section has failed to discriminate the type of the working attachment; and a standard set value setting section for setting, when the discrimination failure display is performed by said display section, the type of the working attachment and a standard value regarding the operation condition of the working attachment; and that said control section is capable of controlling said hydraulic power source based on the operation condition set based on the unique information of the working attachment or information of the standard set value set by said standard wet value setting section.

2. A control apparatus for a construction machine as set forth in claim 1, wherein the control apparatus further comprises a confirmation switch for performing an operation for a premise of start of control by said control section, and said control section starts control of said hydraulic power source after confirming a switch operation by said confirmation switch.

3. A control apparatus for a construction machine as set forth in claim 1, wherein said standard set value setting section includes a plurality of standard set values to which a priority order is applied, and said control section is capable of controlling said hydraulic power source based on the operation condition set based on the unique information of the working attachment or information of a standard set value from said standard set value setting section selected in accordance with the priority order.

4. A control apparatus for a construction machine as set forth in claim 1, wherein said display section performs discrimination failure display when said control section discriminates by a predetermined number of times that the unique information is not normal.

5. A control apparatus for a construction machine as set forth in claim 1, wherein when the standard set value is set by said standard set value setting section, said display section displays the type of the working attachment and the standard set value regarding the operation condition of the working attachment.

6. A control apparatus for a construction machine as set forth in claim 1, wherein the control apparatus further comprises changing means for changing the standard set value.

7. A control apparatus for a construction machine as set forth in claim 6, wherein said changing means includes a changing switch which is capable of being manually operated by an operator.

8. A control apparatus for a construction machine as set forth in claim 7, wherein said changing switch is provided on said display section, and change of the type of the working attachment and the standard set value regarding the operation condition of the working attachment which is performed by an operation of said changing switch is capable of being performed while the type of the working attachment and the standard set value regarding the operation condition of the working attachment displayed on said display section are confirmed.

9. A control apparatus for a construction machine as set forth in claim 1, wherein the control apparatus further comprises a unique information storage member for discriminating the type of the working attachment and storing the unique information for setting the operation condition required by the working attachment in accordance with the type, and said control section automatically sets discrimination of the type of the working attachment and the operation condition required by the working attachment based on the unique information fetched from said unique information storage member.

10. A control apparatus for a construction machine as set forth in claim 9, wherein said unique information storage member is an IC memory.

11. A control apparatus for a construction machine as set forth in claim 9, wherein said unique information storage member is a connector.

12. A control apparatus for a construction machine as set forth in claim 9, wherein said unique information storage member is a bar code.

13. A control apparatus for a construction machine as set forth in claim 9, wherein said unique information storage member is a transmitter.

14. A control apparatus for a construction machine as set forth in claim 13, wherein said transmitter performs transmission of the unique information to said control section by wire communication.

15. A control apparatus for a construction machine as set forth in claim 14, wherein said transmitter performs transmission of the unique information to said control section through a data communication interface.

16. A control apparatus for a construction machine as set forth in claim 14, wherein said transmitter performs transmission of the unique information to said control section through a buffer.

17. A control apparatus for a construction machine as set forth in claim 13, wherein said transmitter performs transmission of the unique information to said control section by radio communication.

18. A control method for a construction machine wherein a working attachment is removably attached to a construction machine body for discriminating a type of the working attachment and controlling a hydraulic power source for supplying working oil to the working attachment based on unique information for setting an operation condition required by the working attachment in accordance with the type, the control method comprising:

a displaying step in which a type display mode wherein the discriminated type of the working attachment is displayed on a display section and a discrimination failure display mode wherein discrimination failure display is performed on said display section when the type of the working attachment cannot be discriminated are taken selectively;

a standard set value setting step of setting, when the discrimination failure display is performed in the displaying step, the type of the working attachment and a standard set value regarding the operation condition of the working attachment; and a controlling step of controlling said hydraulic power source based on the operation condition set based on the unique information of the working attachment or information of the standard set value set in the standard set value setting step.

19. A method for controlling a construction machine having a working attachment removably attached to a machine body, comprising:

discriminating a type of the working attachment;

displaying one of the discriminated type of the working attachment and a discrimination failure;

setting the type of the working attachment and a standard set value regarding an operating condition of the working attachment when the discrimination failure is displayed; and controlling a hydraulic power source supplying a working oil to the working attachment based on unique information for the operating condition required by the working attachment in accordance with the type.

* * * * *